US009301550B2

(12) United States Patent
Sabin

(10) Patent No.: US 9,301,550 B2
(45) Date of Patent: Apr. 5, 2016

(54) APPARATUS FOR PROVIDING TENSION IN GARMENTS AND METHOD OF USE

(71) Applicant: Amy Styczynski Sabin, Dallas, TX (US)

(72) Inventor: Amy Styczynski Sabin, Dallas, TX (US)

( * ) Notice: Subject to any disclaimer, the term of this patent is extended or adjusted under 35 U.S.C. 154(b) by 0 days.

(21) Appl. No.: 14/292,537

(22) Filed: May 30, 2014

(65) Prior Publication Data

US 2014/0359920 A1 Dec. 11, 2014

Related U.S. Application Data

(60) Provisional application No. 61/832,008, filed on Jun. 6, 2013, provisional application No. 61/888,383, filed on Oct. 8, 2013.

(51) Int. Cl.

| | |
|---|---|
| ***A41B 9/00*** | (2006.01) |
| ***A41B 9/04*** | (2006.01) |
| ***A41B 9/02*** | (2006.01) |
| ***A41D 1/06*** | (2006.01) |

(52) U.S. Cl.

CPC . *A41B 9/004* (2013.01); *A41B 9/00* (2013.01); *A41B 9/001* (2013.01); *A41B 9/002* (2013.01); *A41B 9/005* (2013.01); *A41B 9/007* (2013.01); *A41B 9/008* (2013.01); *A41B 9/02* (2013.01); *A41B 9/04* (2013.01); *A41D 1/06* (2013.01); *A41B 2400/38* (2013.01); *A41D 2400/38* (2013.01)

(58) Field of Classification Search

CPC ..... A41B 9/04; A41B 9/004; A41B 9/00; A41B 9/001; A41B 9/002; A41B 9/005; A41B 9/007; A41B 9/008; A41B 9/02; A41D 1/06; A41D 2400/38

USPC ..... 2/406, 49.4, 73, 78.1, 400, 401–403, 2/405

See application file for complete search history.

(56) References Cited

U.S. PATENT DOCUMENTS

| | | | | |
|---|---|---|---|---|
| 3,142,301 | A * | 7/1964 | Erteszek | 450/104 |
| 3,451,063 | A * | 6/1969 | Dwork | 2/402 |
| 3,852,828 | A | 12/1974 | Silverstein | |
| 3,909,847 | A | 10/1975 | Holt et al. | |
| 4,355,425 | A | 10/1982 | Jones et al. | |
| 4,371,989 | A | 2/1983 | Polsky | |

(Continued)

FOREIGN PATENT DOCUMENTS

| | | |
|---|---|---|
| WO | WO9623920 | 8/1996 |

OTHER PUBLICATIONS

"Levi's Shapes Up With Revel Launch," by David Lipke, Jul. 8, 2013, Women's Wear Daily.

(Continued)

*Primary Examiner* — Shaun R Hurley
*Assistant Examiner* — Bao-Thieu L Nguyen
(74) *Attorney, Agent, or Firm* — Hitchcock Evert LLP

(57) ABSTRACT

An apparatus, system and method for providing tension in garments for improving privacy control by the wearer. The apparatus incorporates materials having elastomeric properties which may be placed in proximity to a wearer's crotch during operation. The tension is directed to preventing, concealing and/or obfuscating the curvature or shape of private features of the wearer, such as a woman's labia, from visibility through the garment. The apparatus may include one or more components providing tension for privacy control. The apparatus may include angled seams to obfuscate a woman's private features.

37 Claims, 16 Drawing Sheets

(56) References Cited

U.S. PATENT DOCUMENTS

| | | | | |
|---|---|---|---|---|
| 4,488,317 | A | 12/1984 | Polsky | |
| 4,538,615 | A * | 9/1985 | Pundyk | 450/131 |
| 4,581,771 | A | 4/1986 | Williams | |
| 4,695,279 | A * | 9/1987 | Steer | 604/397 |
| 4,785,480 | A | 11/1988 | Polsky | |
| 4,805,243 | A | 2/1989 | Gibbens et al. | |
| 4,888,006 | A * | 12/1989 | Beaupied | 604/345 |
| 5,081,716 | A | 1/1992 | Lehenbauer et al. | |
| 5,135,520 | A * | 8/1992 | Beaupied | 604/345 |
| 5,143,092 | A | 9/1992 | Flowers | |
| 5,285,531 | A | 2/1994 | Nalbandian | |
| 5,291,617 | A * | 3/1994 | Moretz et al. | 2/400 |
| 5,363,511 | A | 11/1994 | Brewer | |
| 5,392,467 | A * | 2/1995 | Moretz et al. | 2/400 |
| 5,435,014 | A * | 7/1995 | Moretz | A41B 9/02 2/400 |
| 6,041,446 | A * | 3/2000 | Braunstein et al. | 2/400 |
| 6,061,839 | A * | 5/2000 | Smolik | 2/400 |
| RE36,905 | E | 10/2000 | Noble et al. | |
| 6,159,070 | A * | 12/2000 | Schwartz et al. | 450/155 |
| 6,393,621 | B1 * | 5/2002 | Redwine et al. | 2/406 |
| 6,393,622 | B1 * | 5/2002 | Rice | 2/406 |
| 6,817,030 | B2 | 11/2004 | Desai | |
| 6,848,121 | B1 * | 2/2005 | Halid | A61F 13/66 2/400 |
| 6,892,399 | B1 | 5/2005 | Rocha | |
| 7,260,961 | B1 | 8/2007 | Kennedy | |
| 7,533,423 | B2 | 5/2009 | Rudolph | |
| 7,546,751 | B2 | 6/2009 | Lutz | |
| 7,607,964 | B2 | 10/2009 | Mone et al. | |
| 7,685,652 | B2 | 3/2010 | Digney | |
| 7,930,770 | B2 * | 4/2011 | Suga et al. | 2/406 |
| 7,931,639 | B2 * | 4/2011 | Suga et al. | 604/396 |
| 8,123,590 | B2 | 2/2012 | MacKinnon | |
| 8,499,364 | B2 | 8/2013 | Dye | |
| 2003/0019014 | A1 | 1/2003 | Duran | |
| 2004/0154079 | A1 | 8/2004 | Rana et al. | |
| 2004/0230175 | A1 * | 11/2004 | Rainville-Lonn et al. | 604/396 |
| 2005/0197643 | A1 * | 9/2005 | Suga et al. | 604/396 |
| 2005/0229293 | A1 * | 10/2005 | Miller | 2/403 |
| 2008/0010725 | A1 | 1/2008 | Yoo | |
| 2008/0184461 | A1 * | 8/2008 | Utaka | 2/406 |
| 2008/0256676 | A1 | 10/2008 | Di Lorenzo | |
| 2008/0282452 | A1 * | 11/2008 | Suga et al. | 2/406 |
| 2009/0077720 | A1 | 3/2009 | Shinomiya | |
| 2009/0254017 | A1 | 10/2009 | Dumpson et al. | |
| 2010/0037368 | A1 | 2/2010 | Stearns | |
| 2010/0175170 | A1 | 7/2010 | Dye | |
| 2010/0235969 | A1 * | 9/2010 | Isaacson et al. | 2/404 |
| 2011/0099693 | A1 | 5/2011 | Pratt | |
| 2011/0283442 | A1 | 11/2011 | Jorgenson et al. | |
| 2012/0029407 | A1 | 2/2012 | Sawle et al. | |
| 2012/0210496 | A1 | 8/2012 | Laurie | |
| 2012/0237758 | A1 | 9/2012 | Hook | |
| 2014/0101826 | A1 * | 4/2014 | Nearman | 2/407 |

OTHER PUBLICATIONS

"Workout Pants That Won't Give You Camel Toe," posted Jun. 5, 2012, www.wittyandpretty.com, as printed Dec. 11, 2012.

"Camel Ammo Fights Camel Toe," posted Jun. 8, 2009, www.thefrisky.com, as printed Nov. 12, 2014.

Groove Pant *New (Regular), www.shop.lululemon.com, as printed Dec. 11, 2012.

Wunder Under Pant, www.shop.lululemon.com, as printed Dec. 11, 2012.

Camel-Not, www.brazabra.com, as printed Dec. 11, 2012.

The Cuchini, www.cuchini.com, as printed Dec. 11, 2012.

Camelflage, www.camelflage.com, as printed as printed Dec. 11, 2012.

Hold Your Haunches, www.holdyourhaunches.com, as printed on Apr. 1, 2015.

* cited by examiner

APPARATUS FOR PROVIDING TENSION IN GARMENTS AND METHOD OF USE

CROSS-REFERENCE TO RELATED APPLICATION

This application claims the benefit of priority from U.S. Provisional Patent Application No. 61/832,008 filed on Jun. 6, 2013 and U.S. Provisional Patent Application No. 61/888,383 filed on Oct. 8, 2013, which are incorporated herein by reference.

FIELD OF THE DISCLOSURE

The present invention relates to improvements in ladies garments, and particularly to the construction of a privacy feature in the construction of the crotch area of the garment.

BACKGROUND

Some garments worn by women may naturally fit a woman's body tightly or in such close proximity that the form of a woman's body shows through the garment. Other garments may move with respect to a woman's body such that one or more portions of the form of a woman's body shows through the garment at one or more times while the garment is worn. In some situations, the form of a woman's body shows through the garment during certain actions of the wearer, but not during other actions.

One problem which may be created by such garments worn on the bottom half of a woman's body is the undesirable fitting around one's crotch area. Some of such garments may form to the woman's crotch in such a way as to allow the curvature of the woman's vulva or labia to be visible through the garment. This undesirable exposure of the external portion of the female's genitalia is sometimes euphemistically referred to as cameltoe and may create an undesired "W" shape in woman's garments. In addition, this undesirable exposure may be further accentuated by a seam directly up the center of the crotch. Although a woman may wish to wear such garments for one or more aesthetic or functional reasons, the collateral problems with over exposure caused by such garments is undesirable.

SUMMARY

The present disclosure provides a variety of embodiments of a privacy feature for incorporation or use in conjunction with a variety of garments to conceal, eliminate, and/or obfuscate the undesirable exposure of a person's anatomy. Embodiments may include materials which provide tension at and/or around one or more portions of the person's anatomy which are not intended to be visible in form or otherwise through a garment.

Some embodiments of the present disclosure provide for women's undergarments which include one or more elastomeric layers in the front of the undergarment. The elastomeric layers may provide tension on or around the wearer's crotch in order to hold the labia against the wearer's crotch and conceal, obfuscate, and/or eliminate the form of the labia from being externally visible.

In some embodiments, the tension may be created using two elastomeric layers which cross proximate to the desired area for privacy. In some embodiments, the tension may be created using a single elastomeric layer. In such embodiments, the elastomeric layer may be designed to create variations in tension through the material.

In some embodiments, the one or more elastomeric layers may be designed from a variety of materials. Some materials may be designed to provide additional characteristics to the elastomeric features, such as breathability, moisture absorption, and/or other characteristics.

In some embodiments, the undergarments may include a liner material between all or a portion of the wearer's skin and the one or more elastomeric layers. Some liner material may be designed to provide breathability, moisture absorption, feminine hygiene and/or other characteristics.

In some embodiments, the elastomeric layers may be encased and concealed within fabric designed from one or more materials. In some embodiments, the external layer of the encasement may serve as the external layer of the garment itself.

Some embodiments of the present disclosure provide for other garments meant to cover a wearer's crotch, such as pants, jeans, shorts, bathing suits, skirts, and other garments. Embodiments of such garments may include one or more elastomeric layers in the front of the garment. The elastomeric layers may provide tension on or around the wearer's crotch in order to hold the external portion of the genitalia against the wearer's crotch and conceal, obfuscate, and/or eliminate the form of the external portion of the genitalia from being externally visible.

In some embodiments, the tension may be created using two elastomeric layers which cross proximate to the desired area for privacy. In some embodiments, the tension may be created using a single elastomeric layer. In such embodiments, the elastomeric layer may be designed to create variations in tension through the material.

In some embodiments, the one or more elastomeric layers may be designed from a variety of materials. Some materials may be designed to provide additional characteristics to the elastomeric features, such as breathability, moisture absorption, and/or other characteristics.

In some embodiments, the garments may include a liner material between all or a portion of the wearer's skin and the one or more elastomeric layers. Some liner material may be designed to provide breathability, moisture absorption, feminine hygiene and/or other characteristics.

In some embodiments, these elastomeric layers may be encased and concealed within fabric designed from one or more materials. In some embodiments, the three-layer panel can be sewn, adhered, and/or otherwise attached to the bottom of the garment.

In some embodiments, the wearer of a garment including features of the present disclosure may also wear another garment without such features underneath the garment which includes features of the present disclosure. In some embodiments, the wearer of a garment including features of the present disclosure may elect not to wear another garment.

In some embodiments, the elastomeric layers may be permanently connected to the garment. In other embodiments, the elastomeric layers may be temporarily connected to the garment.

A BRIEF DESCRIPTION OF THE DRAWINGS

Embodiments will now be described, by way of example only, with references to the accompanying drawings in which.

DETAILED DESCRIPTION

While this invention may be embodied in many different forms, there will herein be described in detail illustrative embodiments with the understanding that the present disclosure is to be considered as an exemplification of the principles and is not intended to limit the broad aspects of the invention to the embodiments illustrated. It will be understood that the invention may be embodied in other specific forms without departing from the spirit or central characteristics thereof. The present embodiments, therefore, are to be considered in all respects as illustrative and not restrictive, and the invention is not to be limited to the details given herein.

Figure 1:
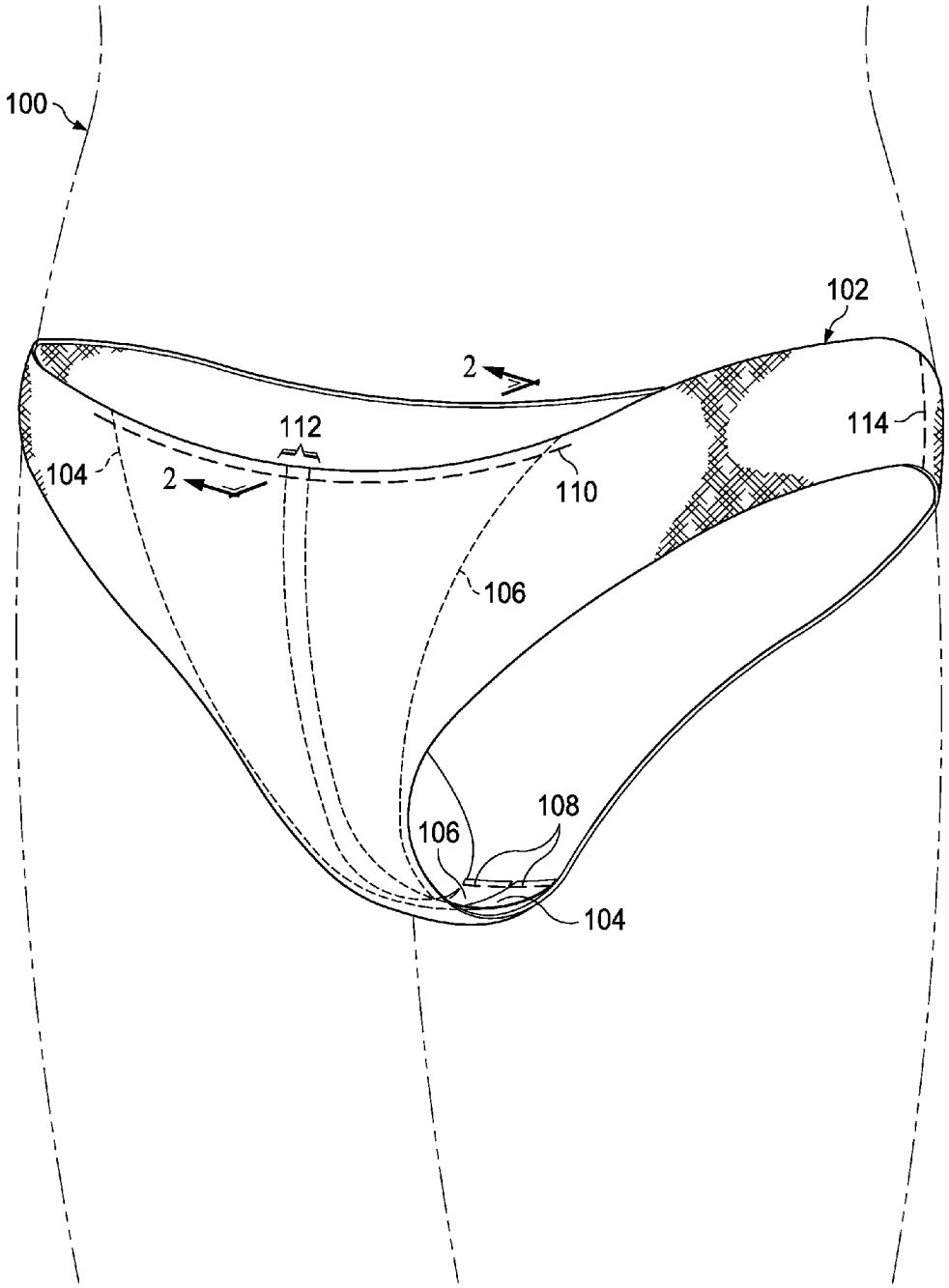
FIG. 1 shows an embodiment of an undergarment depicting two elastomeric layers.

FIG. 1 depicts an embodiment of a privacy control undergarment 102 as worn on a person 100. The person 100 is illustrated to provide a contextual reference for the use of the undergarment 102. Undergarment 102 may also be referred to as any form of underwear, such as a panty, thong, girdle, pantyhose, support wear, or any other term for underwear. One skilled in the art will recognize that the undergarment 102 may vary in design, materials and/or style and remain within the scope and spirit of the present disclosure. For example, undergarment 102 may include any style of panty design, such as thong, brief, boy short, low rise, bikini, full-bottom, and other styles.

In this embodiment, undergarment 102 includes a tension layer proximate to the crotch of person 100. The tension layer of this embodiment comprises a first tension component 104 and a second tension component 106. Each of the tension components 104 and 106 are attached along the top of the undergarment 102 at top connection 110 and attached at the base of undergarment 102 at bottom connection 108. Top connection 110 and bottom connection 108 are depicted in this embodiment as seams. One skilled in the art will recognize that the connections 108 and 110 may comprise any one or more manners for attaching the tension components 104 and 106 to the undergarment 102. For example, bottom connection 108 may comprise a stitched seam and top connection 110 may comprise an adhesive. In some embodiments, the top connection 110 may be a dropped connection from the top of the undergarment 102. For example, the dropped connection may be one or several inches from the top of the undergarment 102.

The tension components 104 and 106 cross each other such that an increased level of support is provided around a desired location wherein tension components 104 and 106 overlap. Overlap portion 112 shows the overlap in the front of the tension layer of undergarment 102. In some embodiments, the undergarment 102 is a woman's underwear, and the tension layer is utilized to conceal, eliminate and/or obfuscate the external portion of a woman's genitalia when the undergarment 102 is worn. The tension provided by the tension components 104 and 106 decreases the projection, protrusion and/or appearance of a woman's labia folds in undergarment 102.

When a woman is wearing undergarment 102, tension component 106 extends from one side of bottom connection 108 diagonally to the opposite side of top connection 110 and is operatively engaged with the crotch of the woman to provide a pressure against the external portion of the woman's genitalia. In addition, tension component 104 extends from the other side of bottom connection 108 from tension component 106 diagonally to the opposite side of top connection 110 crossing over tension component 106 and is operatively engaged with the crotch of the woman to provide a pressure against the external portion of the woman's genitalia. The angular overlap creates a cross-directional pressure in the overlap portion 112. The overlap portion 112 may be designed to cover the woman's labia such that a combined pressure created by each of tension components 104 and 106 is applicable to at least a portion of the woman's labia. In some embodiments, the overlap portion 112 is designed to cover the woman's labia completely.

In some embodiments, the pressure from tension components 104 and 106 is in an upward direction to lift the labia and conceal, eliminate and/or obfuscate any visible curvature of the female anatomy. In some embodiments, the pressure from tension components 104 and 106 is in a direction towards the woman's back to conceal, eliminate and/or obfuscate any visible curvature of the female anatomy. The pressure may be directed in one or more directions, such as upward, inward, outward, towards the woman's back and/or combinations thereof, to create pressure against a woman's body in order to conceal, eliminate and/or obfuscate any visible curvature of the female anatomy. One skilled in the art will recognize that the direction of pressure created by the tension layer may vary while operating to conceal, eliminate and/or obfuscate any visible curvature of the female anatomy.

Embodiments of undergarments with tension layers may be designed to fit different sizes and shapes of the various wearers. In addition, the extent and location of pressure provided by the tension layer may vary in different embodiments. In some embodiments, the undergarment 102 in conjunction with the tension components 104 and 106 may be designed to fit differing body types through the extent, location, size and other characteristics of the tension components. In some embodiments, the undergarment 102 in conjunction with the tension components 104 and 106 may be designed to compliment another garment to wear over undergarment 102. For example, a user may prefer a higher pressure undergarment 102 when wearing other garments that are more likely to expose the female anatomy, such as thin and/or tight fitting garments like yoga pants, workout shorts, or leggings, and a lower pressure undergarment 102 when wearing other garments that are not as likely to expose the female anatomy, such as thick and/or looser garments. One skilled in the art will recognize that the number of tension layers and/or tension components within a tension layer may vary and remain within the scope and spirit of the present disclosure.

Figure 2:
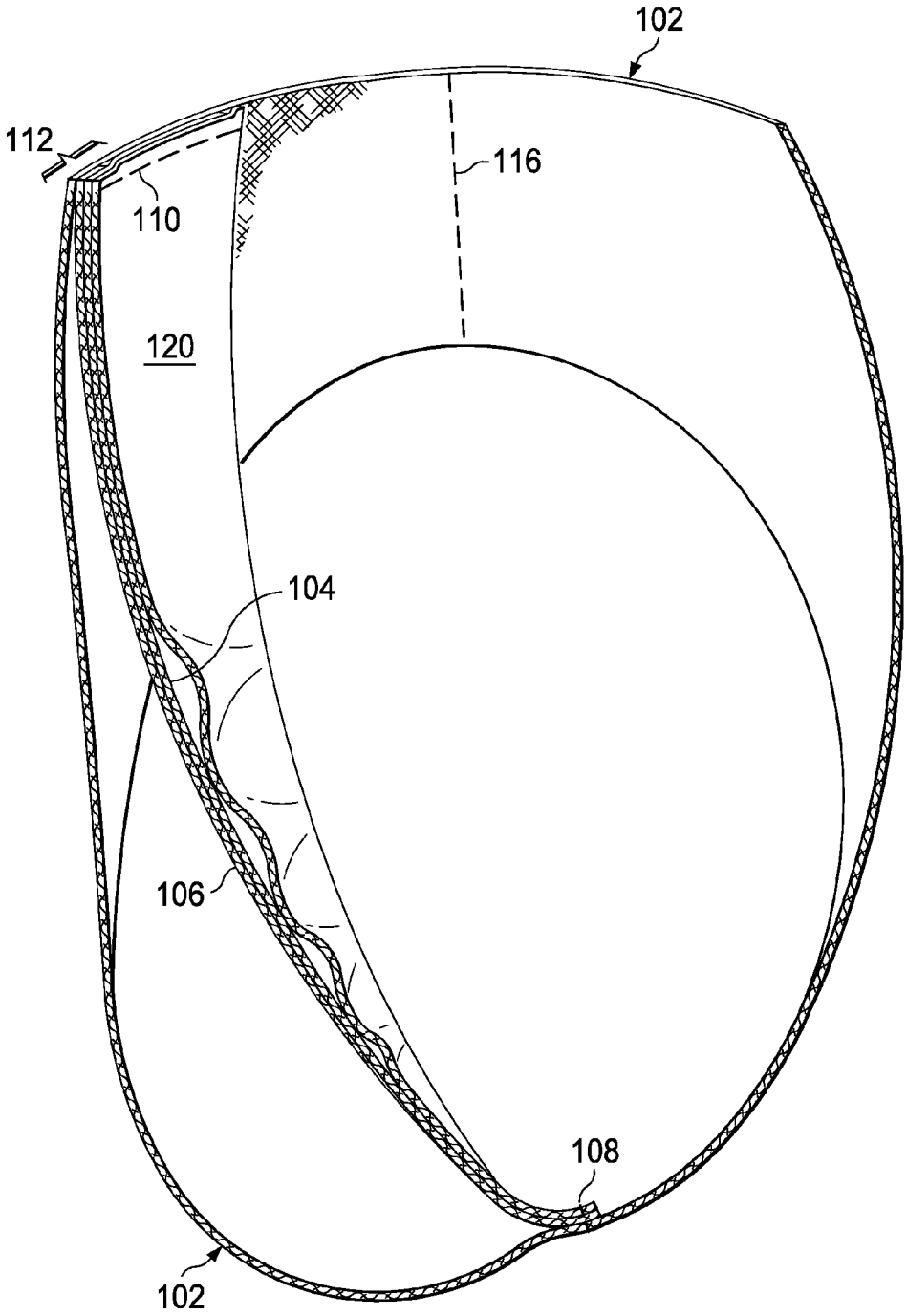
FIG. 2 shows a cross-sectional side view of another embodiment of an undergarment.

FIG. 2 shows a cross-sectional view of an embodiment of an undergarment 102. The cross-section is taken along the point illustrated by the arrows and numbers "2" shown in FIG. 1. The embodiment in FIG. 2 is similar to the embodiment in FIG. 1. FIG. 2 depicts undergarment 102 including the tension layer comprising a first tension component 104 and a second tension component 106. In addition, this embodiment includes an internal liner 120 above the tension layer. Each of the liner 120 and the tension components 104 and 106 are attached along the top of the undergarment 102 at top connection 110 and attached at the base of undergarment 102 at bottom connection 108.

In some embodiments, the undergarment 102 and liner 120 are longer than the tension layer when relaxed. When the tension layer attached to the undergarment 102 is stretched by a wearer, the tension layer expands to approximately the same length as the undergarment 102 and liner 120. For example, when undergarment 102 is not being worn, as shown in FIG. 2, the material of the undergarment 102 and the liner 120 may be looser than the tension layer which is relaxed. This difference is illustrated by the sagging front section of undergarment 102 and the waves in the liner 120. Stretching the tension components 104 and 106 beyond the material's natural or relaxed state may create the pressure against the person's body in whole or in part. In some embodiments, the undergarment 102 and liner 120 are the same length as the tension layer when relaxed.

In some embodiments, the material and/or design of internal liner 120 may provide additional comfort for the wearer. For example, some people may prefer soft, smooth and/or delicate materials for skin contact. In addition, the liner 120 may limit any discomfort caused by the materials utilized for tension components 104 and 106 and/or directional tension created by the tension components 104 and 106. In some embodiments, the design and/or materials of the liner 120 may provide comfort features such as moisture control, odor absorption and other features. In some embodiments which do not include liner 120, the tension layer may incorporate one or more comfort features.

Figure 3:
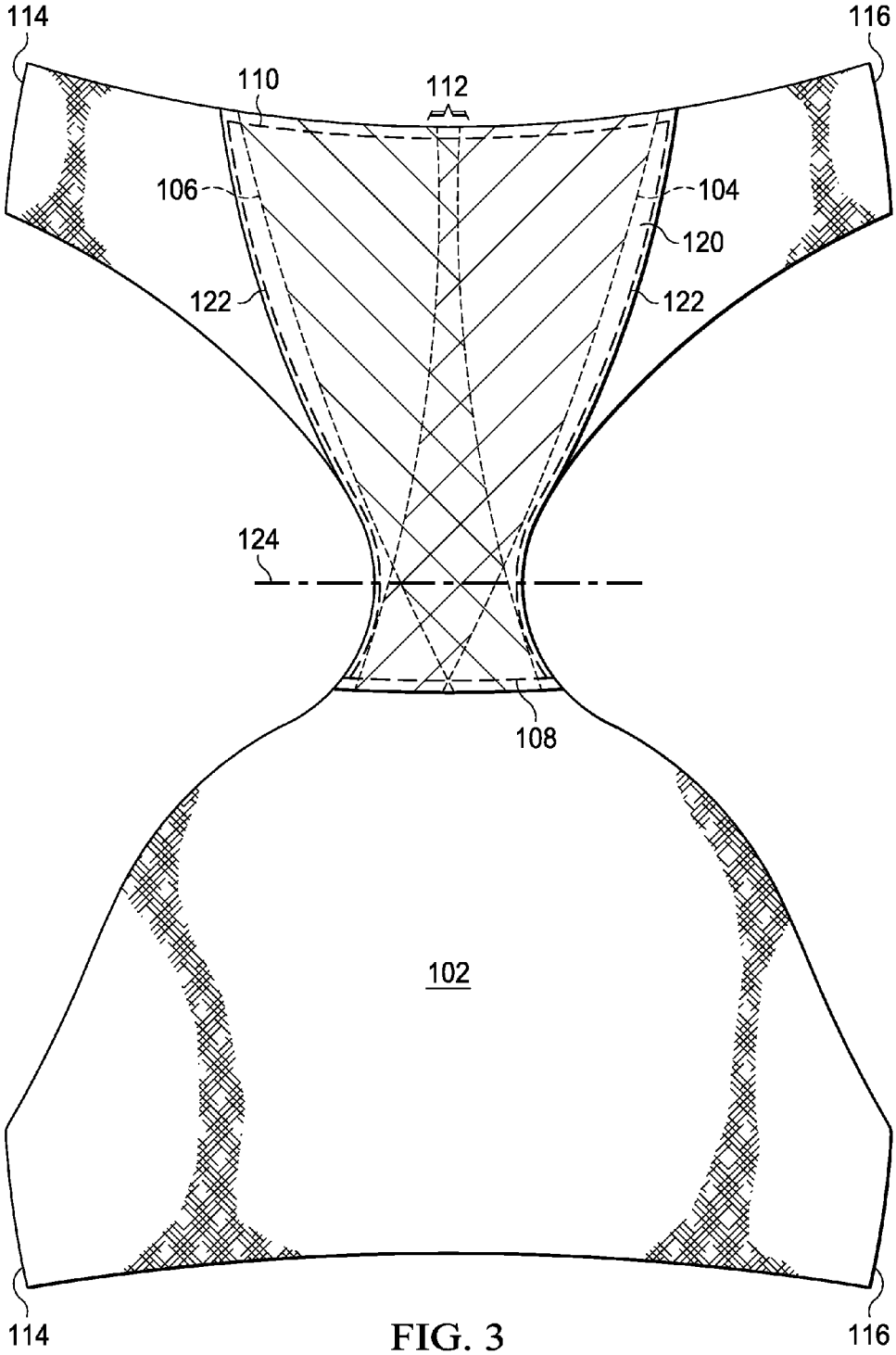
FIG. 3 shows a flat view of the undergarment shown in FIG. 2.

FIG. 3 depicts an embodiment of the undergarment 102 with the liner 120 in a flat layout for illustrative purposes. Sides 114 and 116 are depicted in FIGS. 1 and 2 as contextual reference points for further illustrating the flat layout depictions such as the flat layout in FIG. 3. In some embodiments, sides 114 and 116 may include seams to form the undergarment 102. In FIG. 3, sides 114 and 116 are shown at corresponding locations on the top and bottom of the flat layout of the undergarment 102 to illustrate the locations where the sides 114 and 116 would be connected to form undergarment 102. The flat layout provides further detail of the components of the undergarment 102, including the layout of components in this embodiment.

In this embodiment, the tension layer comprising tension components 104 and 106 are shown under an internal liner 120. Tension components 104 and 106 are each shown with different markings to better illustrate the layout of each of tension component 104 and 106. In addition, overlap portion 112 is shown with the both sets of markings to illustrate the area in which the tension components 104 and 106 cross each other. In this embodiment, the primary area of the overlap portion 112 is designed to correspond to the wearer's crotch. For example, when worn by a woman, the overlap portion 112 would be designed to cover the labia of the woman in order to focus the pressure at the desired location to conceal, obfuscate and/or eliminate any view of the curvature of the woman's labia. In some embodiments, the overlap portion may only cover a portion of the woman's labia. One skilled in the art will recognize that one design of undergarment 102 may operate, affect or be worn differently by different women due to a variety of characteristics associated with each woman's body type. Elements of this disclosure may be varied to create a series of garments to correspond to various body types, in order to provide users with the options to select garments best suited for that user's body type.

In this embodiment, tension components 104 and 106 are attached along the front at top connection 110 and along the base at bottom connection 108. First tension component 104 extends from the right side of top connection 110 to the left side of bottom connection 108. Second tension component 106 extends from the left side of top connection 110 to the right side of bottom connection 108. The two tension components cross each other in overlap portion 112. In some embodiments, tension components 104 and 106 are wider along top connection 110 than they are along bottom connection 108. In some embodiments, the tension components 104 and 106 are rectangular strips of material. One skilled in the art will recognize that that the size, shape and other characteristics of the tension components may vary and remain within the scope and spirit of the present disclosure.

In some embodiments, liner 120 covers the tension components 104 and 106. Liner 120 is depicted attached at top connection 110 and bottom connection 108 along with the tension components 104 and 106. In some embodiments, liner 120 and tension components 104 and 106 are attached at top connection 110 and bottom connection 108 in the same manner or the same connecting component, such as a seam or adhesive connecting undergarment 102 with tension components 104 and 106 and liner 120. In some embodiments, the tension components 104 and 106 may be connected in one manner, such as a seam, and the liner 120 may be connected using another connecting component, such as an adhesive material. Embodiments of the present disclosure may incorporate one or more types, systems, materials, components or other connections for attaching the disclosed components. In some embodiments, the undergarment 102 including the tension components 104 and 106 and liner 120 may be created in conjunction as a single garment wherein each layer is connected as desired locations through integrated weaving of the materials.

In the embodiment shown, liner 120 is also attached to undergarment 102 along the side connections 122. In some embodiments, the side connections 122 are beyond the edge of tension components 104 and 106, whereby the tension components 104 and 106 remain free to expand and contract within the space encapsulated between undergarment 102 and liner 120. In some embodiments, liner 120 is not connected to undergarment 102 along the sides, but is designed to remain between the tension layer and the person's skin when worn.

In some embodiments, liner 120 may only cover a portion of the tension layer. For example, liner 120 may extend from connection 108 only halfway to the top connection 110. The size, shape, design, coverage and/or other features of the liner 120 may vary and remain within the scope and spirit of the present disclosure. In some embodiments, liner 120 may include multiple layers of differing sizes for a variety of purposes. For example, one layer of liner 120 may encase the tension components 104 and 106 with a breathable thin material for comfort while a second layer only extends a portion of the way from bottom connection 108 and is designed for moisture absorption and feminine hygiene. In some embodiments, the characteristics of the liner 120 may be varied for a variety of considerations such as aesthetic, functional, comfort and/or other considerations.

FIG. 3 also includes center line 124 illustrating the center of the bottom of undergarment 102. As illustrated, bottom connection 108 is located below center line 124 in this embodiment. Accordingly, when undergarment 102 is worn, the tension components 104 and 106 extend from behind center line 124 to the waist line of the undergarment 102. This may provide more upward pressure against the wearer's crotch for support. One skilled in the art will recognize that the location of bottom connection 108 and/or top connection 110 may vary and effect the scope, focus, location, extent and/or other characteristic associated with the pressure created by the tension layer.

In addition, aesthetic characteristics associated with the design of the undergarment 102 may influence the location and/or type of connection utilized. For example, a seam along bottom connection 108 may be visible through other garments worn over the undergarment 102. In order to conceal the bottom connection 108, the location of bottom connection 108 may be shifted closer to the center line 124 or the bottom connection 108 may be designed using a different connection, such as an adhesive, a zipper, hook and loop tape, a fitted connection and/or a friction connections. As disclosed further herein, the design and characteristics of the tension layer and/or other components may be varied to account for a variety of considerations including the aesthetic factors.

Figure 4:
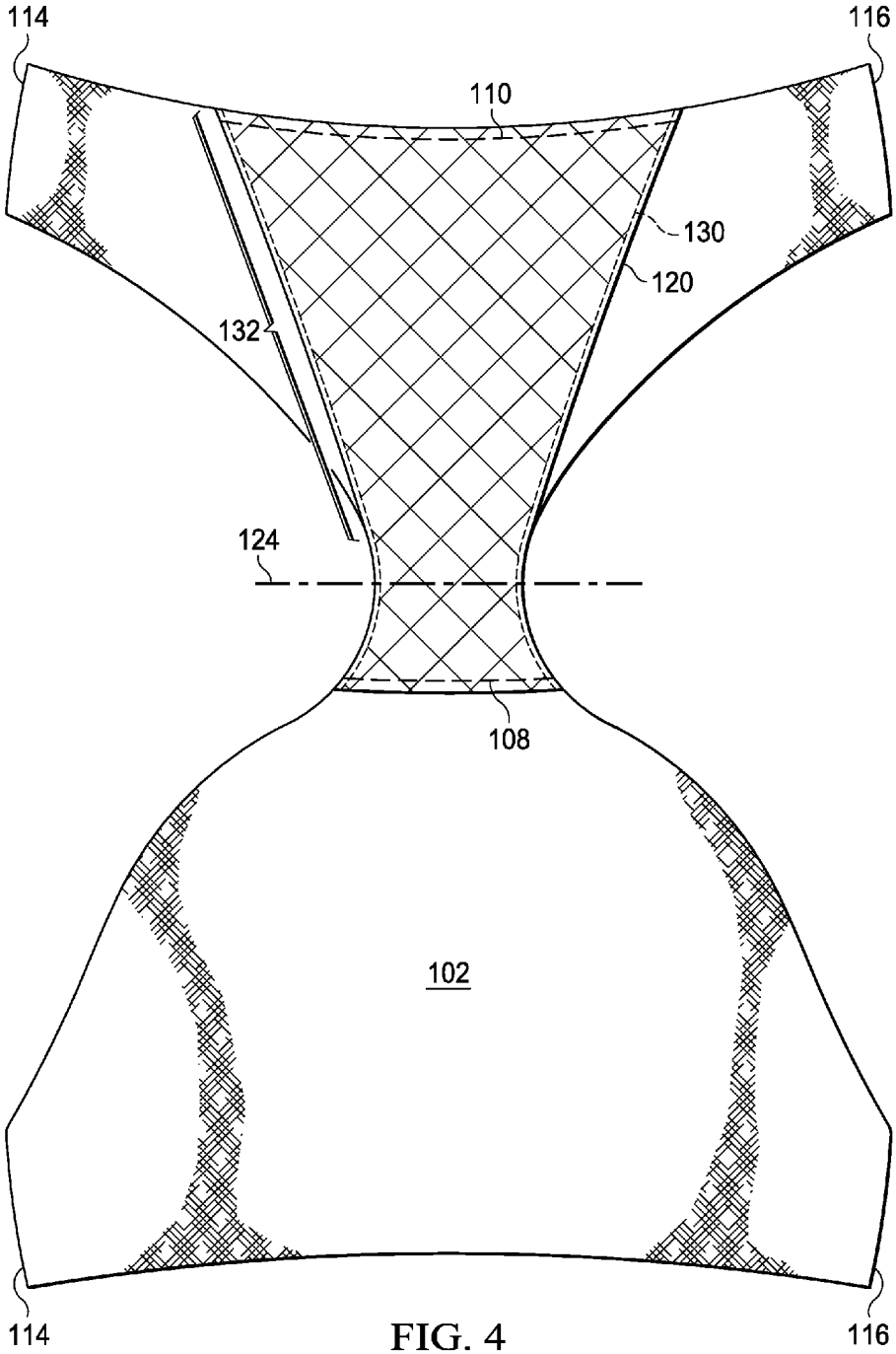
FIG. 4 shows another embodiment of an undergarment depicting a single elastomeric layer.

FIG. 4 depicts another embodiment of the undergarment 102 with the liner 120 in a flat layout for illustrative purposes. As discussed with FIG. 3, sides 114 and 116 are shown at corresponding locations on the top and bottom of the flat layout of the undergarment 102 to illustrate the locations where the sides 114 and 116 would be connected to form undergarment 102.

In this embodiment, the tension layer comprises a tension component 130 shown under an internal liner 120. Tension component 130 may perform the same functions as multiple tension components. One skilled in the art will recognize that one or more tension components may be utilized in embodiments of the disclosure. In some embodiments, tension component 130 may provide a constant tension characteristic across the entirety of the tension component 130. For example, tension component 130 may comprise a single elastomeric fabric which provides a constant tension throughout the material.

In some embodiments, the tension component 130 is designed to provide a variety of tension characteristics at locations through the fabric. For example, tension component 130 may be constructed to provide more tension at desired locations, such as the anticipated area proximate to the wearer's labia, and lower levels of tension at other locations, such as the edge of the tension component 130. For another example, the tension component 130 may be constructed to focus tension in desired directions, such as crossing angular directions. When providing crossing angular tension, the area in which the tension crosses may comprise the area of focused tension associated with the wearer's crotch. The design of the materials, dimensions, tension and other characteristics of tension component 130 may be varied to conceal, obfuscate or eliminate the curvature of the wearer's body. The tension component 130 may be controlled, influenced, or modified through fabric design methods including weaving, material selection, layering, tension modification techniques and/or other means of influencing the tension characteristics.

When worn by a woman, the tension component 130 and/or an active or selected portion of tension component 130 would be designed to cover the labia of the woman in order to focus the pressure at the desired location to conceal, obfuscate and/or eliminate any view of the curvature of the woman's labia. One skilled in the art will recognize that one design of undergarment 102 may operate, affect or be worn differently by different women due to a variety of characteristics associated with each woman's body type. Elements of this disclosure may be varied to create a series of garments to correspond to various body types, in order to provide users with the options to select garments best suited for that user's body type.

In this embodiment, tension component 130 is attached along the front at top connection 110 and along the base at bottom connection 108. In some embodiments, tension component 130 is wider along top connection 110 than it is along bottom connection 108. In some embodiments, the tension component 130 is a rectangular strip of material. One skilled in the art will recognize that that the size, shape and other characteristics of the tension component may vary and remain within the scope and spirit of the present disclosure.

Liner 120 is depicted attached at top connection 110 and bottom connection 108 along with the tension component 130. In some embodiments, liner 120 and tension component 130 may be attached independently at top connection 110 and/or bottom connection 108. In some embodiments, liner 120 may be attached in conjunction with tension component 130 at top connection 110 and/or bottom connection 108. Embodiments of the present disclosure may incorporate one or more types, systems, materials, components or other connections for attaching the disclosed components. In some embodiments, the undergarment 102 including the tension component 130 and liner 120 may be created in conjunction as a single garment wherein each layer is connected at desired locations through integrated weaving of the materials.

In some embodiments, liner 120 is not connected to undergarment 102 along the sides, but is designed to remain between the tension component 130 and the person's skin when worn. In some embodiments, liner 120 is designed to be wider than the tension component 130 to ensure the entire tension component 130 remains covered during operation. In some embodiments, the sides of liner 120 may be connected along some portions of undergarment 102, but not attached along other portions of undergarment 102. For example, in FIG. 4 section 132 of the liner 120 may not be attached on either side while the remainder of liner 120 is attached to undergarment 102. In some embodiments, the tension component 130 remains free to expand and contract within the space between undergarment 102 and liner 120. In some embodiments, liner 120 is connected to undergarment 102 along the sides wherein the liner 120 does not obstruct the expansion or contraction of the tension component 130.

In this embodiment, center line 124 illustrates the center of the bottom of undergarment 102. Bottom connection 108 is located below center line 124 in this embodiment. When undergarment 102 is worn, the tension component 130 extends from behind center line 124 to the waist line of the undergarment 102. If the tension is constant in the material of the tension component 130, this placement of bottom connection 108 may provide more upward pressure against the wearer's crotch for support. One skilled in the art will recognize that the location of bottom connection 108 and/or top connection 110 may vary and effect the scope, focus, location, extent and/or other characteristic associated with the pressure created by the tension layer.

As discussed above, aesthetic characteristics associated with the design of the undergarment 102 may also influence the location and/or type of connection utilized. As disclosed further herein, the design and characteristics of the tension layer and/or other components may be varied to account for a variety of considerations including the aesthetic factors.

Figure 5:
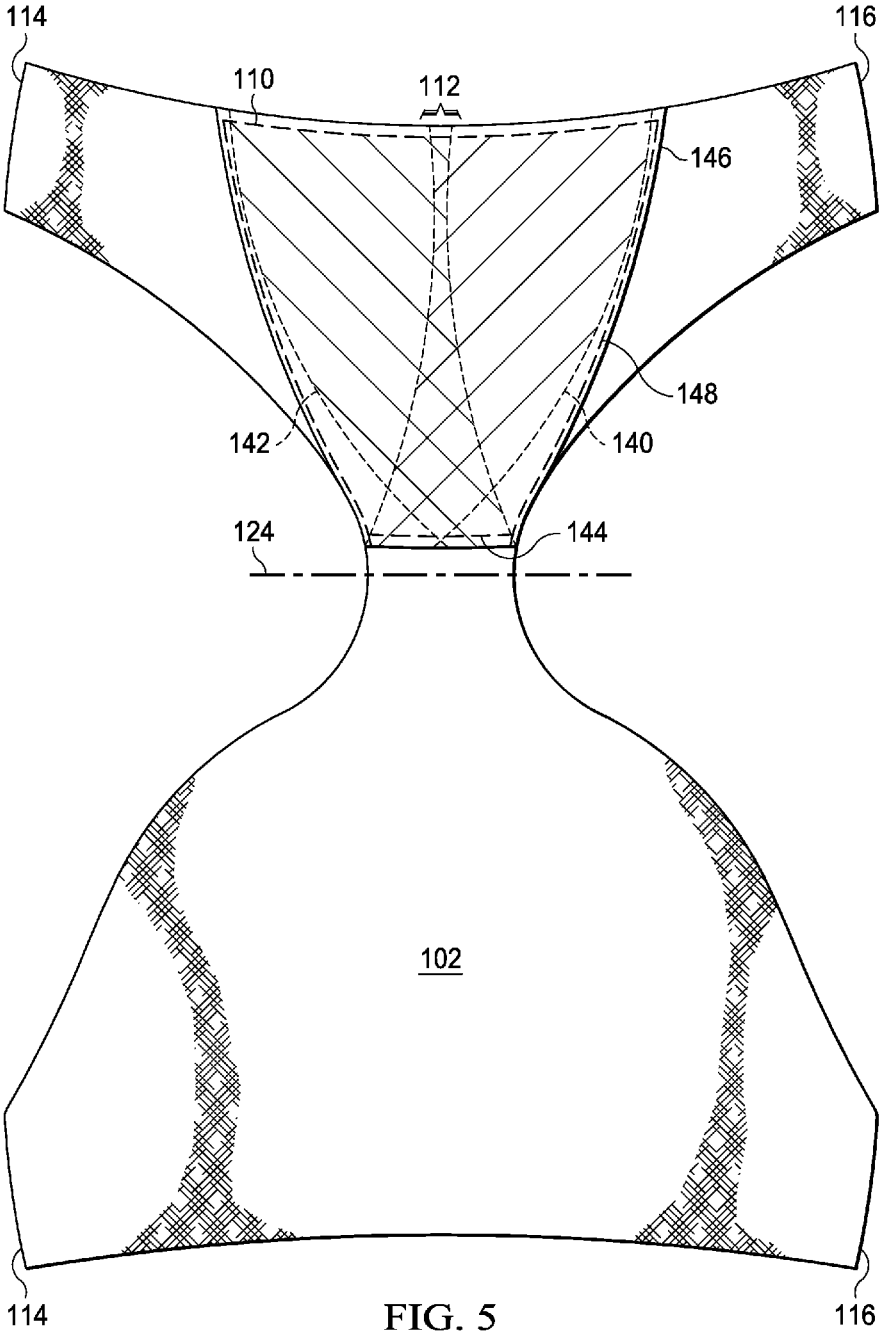
FIG. 5 is another embodiment of an undergarment depicting two elastomeric layers.

FIG. 5 depicts another embodiment of the undergarment 102 in a flat layout for illustrative purposes. As discussed with FIG. 3, sides 114 and 116 are shown at corresponding locations on the top and bottom of the flat layout of the undergarment 102 to illustrate the locations where the sides 114 and 116 would be connected to form undergarment 102.

In this embodiment, the tension layer comprises a first tension component 140 and a second tension component 142 which are shown under an internal liner 146. Tension components 140 and 142 are each shown with different markings to better illustrate the layout of each of tension component 140 and 142. In addition, overlap portion 112 is shown with the both sets of markings to illustrate the area in which the tension components 140 and 142 cross each other. In this embodiment, the primary area of the overlap portion 112 is designed to correspond to the wearer's crotch. For example, when worn by a woman, the overlap portion 112 would be designed to cover the labia of the woman in order to focus the pressure at the desired location to conceal, obfuscate and/or eliminate any view of the curvature of the woman's labia. In some embodiments, the overlap portion may only cover a portion of the woman's labia. One skilled in the art will recognize that one design of undergarment 102 may operate, affect or be worn differently by different women due to a variety of characteristics associated with each woman's body type. Elements of this disclosure may be varied to create a series of garments to correspond to various body types, in order to provide users with the options to select garments best suited for that user's body type.

In this embodiment, tension components 140 and 142 are attached along the front at top connection 110 and along the base at bottom connection 144. First tension component 140 extends from the right side of top connection 110 to the left side of bottom connection 144. Second tension component 142 extends from the left side of top connection 110 to the right side of bottom connection 144. The two tension components cross each other in overlap portion 112. In some embodiments, tension components 140 and 142 are wider along top connection 110 than they are along bottom connection 144. In some embodiments, the tension components 140 and 142 are rectangular strips of material. One skilled in the art will recognize that that the size, shape and other characteristics of the tension components may vary and remain within the scope and spirit of the present disclosure.

In some embodiments, liner 146 covers the tension components 140 and 142. Liner 146 is depicted attached at top connection 110 and bottom connection 144 along with the tension components 140 and 142. As discussed further above, embodiments may be attached and/or integrated with a variety of techniques and components and remain within the scope and spirit of the disclosure. Embodiments of the present disclosure may incorporate one or more types, systems, materials, components or other connections for attaching the disclosed components.

In the embodiment shown, liner 146 is also attached to undergarment 102 along the side connections 148. In some embodiments, the side connections 148 are beyond the edge of tension components 140 and 142, whereby the tension components 140 and 142 remain free to expand and contract within the space between undergarment 102 and liner 146. In some embodiments, liner 146 is not connected to undergarment 102 along the sides, but is designed to remain between the tension layer and the person's skin when worn.

FIG. 5 also includes center line 124 illustrating the center of the bottom of undergarment 102. As illustrated, bottom connection 144 is located above center line 124 in this embodiment. When undergarment 102 is worn, the tension components 140 and 142 extend from above center line 124 to the waist line of the undergarment 102. In such embodiments, the design may provide more inward pressure against the wearer's crotch for support than upward pressure. One skilled in the art will recognize that the location of bottom connection 144 and/or top connection 110 may vary and effect the scope, focus, location, extent and/or other characteristic associated with the pressure created by the tension layer. In addition, aesthetic characteristics associated with the design of the undergarment 102 may influence the location and/or type of connection utilized. As disclosed further herein, the design and characteristics of the tension layer and/or other components may be varied to account for a variety of considerations including the aesthetic factors.

Figure 6:
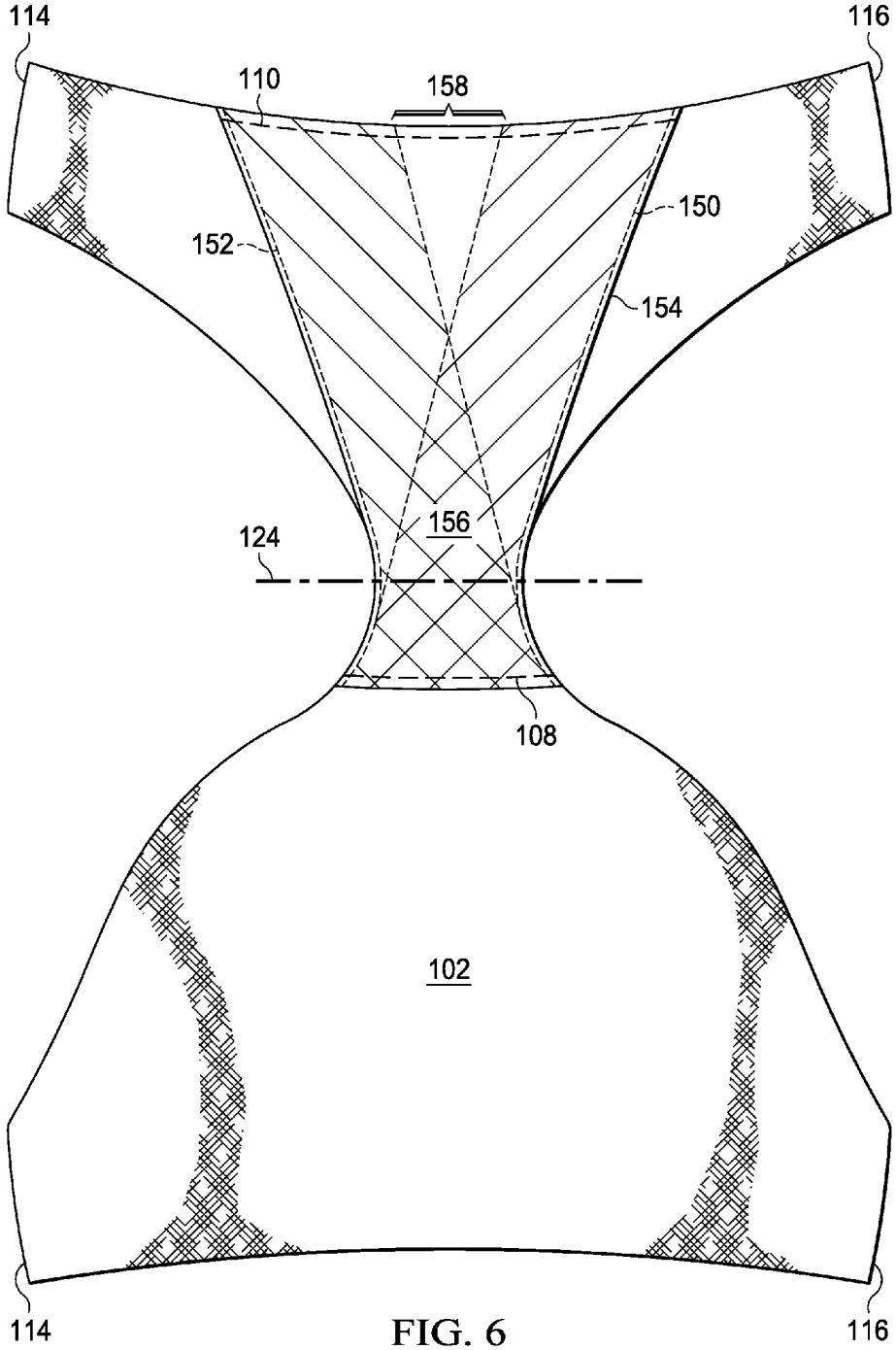
FIG. 6 is another embodiment of an undergarment depicting two elastomeric layers.

FIG. 6 depicts another embodiment of the undergarment 102 in a flat layout for illustrative purposes. As discussed with FIG. 3, sides 114 and 116 are shown at corresponding locations on the top and bottom of the flat layout of the undergarment 102 to illustrate the locations where the sides 114 and 116 would be connected to form undergarment 102.

In this embodiment, the tension layer comprises a first tension component 150 and a second tension component 152 which are shown under an internal liner 154. Tension components 150 and 152 are each shown with different markings to better illustrate the layout of each of tension component 150 and 152. In addition, overlap portion 156 is shown with the both sets of markings to illustrate the area in which the tension components 150 and 152 cross each other. In some embodiments, a gap area 158 exists between tension components 150 and 152, and does not include any tension element. In this embodiment, the primary area of the overlap portion 156 is designed to correspond to the wearer's crotch. For example, when worn by a woman, the overlap portion 156 would be designed to cover the labia of the woman in order to focus the pressure at the desired location to conceal, obfuscate and/or eliminate any view of the curvature of the woman's labia. In some embodiments, the overlap portion may only cover a portion of the woman's labia. One skilled in the art will recognize that one design of undergarment 102 may operate, affect or be worn differently by different women due to a variety of characteristics associated with each woman's body type. Elements of this disclosure may be varied to create a series of garments to correspond to various body types, in order to provide users with the options to select garments best suited for that user's body type.

In this embodiment, tension components 150 and 152 are attached along the front at top connection 110 and along the base at bottom connection 108. First tension component 150 extends from the right side of top connection 110 to the left side of bottom connection 108. Second tension component 152 extends from the left side of top connection 110 to the right side of bottom connection 108. The two tension components cross each other in overlap portion 156. In some embodiments, tension components 150 and 152 do not overlap along top connection 110 creating gap area 158. One skilled in the art will recognize that that the size, shape and other characteristics of the tension components may vary and remain within the scope and spirit of the present disclosure.

In some embodiments, liner 154 covers the tension components 150 and 152. Liner 154 is depicted attached at top connection 110 and bottom connection 108 along with the tension components 150 and 152. As discussed further above, embodiments may be attached and/or integrated with a variety of techniques and components and remain within the scope and spirit of the disclosure. Embodiments of the present disclosure may incorporate one or more types, systems, materials, components or other connections for attaching the disclosed components. In some embodiments, the edges of liner 154 are beyond the edges of tension components 150 and 152, whereby the tension components 150 and 152 remain free to expand and contract within the space between undergarment 102 and liner 154. In some embodiments, liner 154 prevents or limits pinching and/or other unwanted ancillary effects of the tension components 150 and 152.

In this embodiment, center line 124 illustrates the center of the bottom of undergarment 102. Bottom connection 108 is located below center line 124 in this embodiment. When undergarment 102 is worn, the tension components 140 and 142 extend from behind center line 124 to the waist line of the undergarment 102. In such embodiments, the design may provide more upward pressure against the wearer's crotch for support. One skilled in the art will recognize that the location of bottom connection 108 and/or top connection 110 may vary and effect the scope, focus, location, extent and/or other characteristic associated with the pressure created by the tension layer.

As discussed above, aesthetic characteristics associated with the design of the undergarment 102 may also influence the location and/or type of connection utilized. As disclosed further herein, the design and characteristics of the tension layer and/or other components may be varied to account for a variety of considerations including the aesthetic factors.

Figure 7:
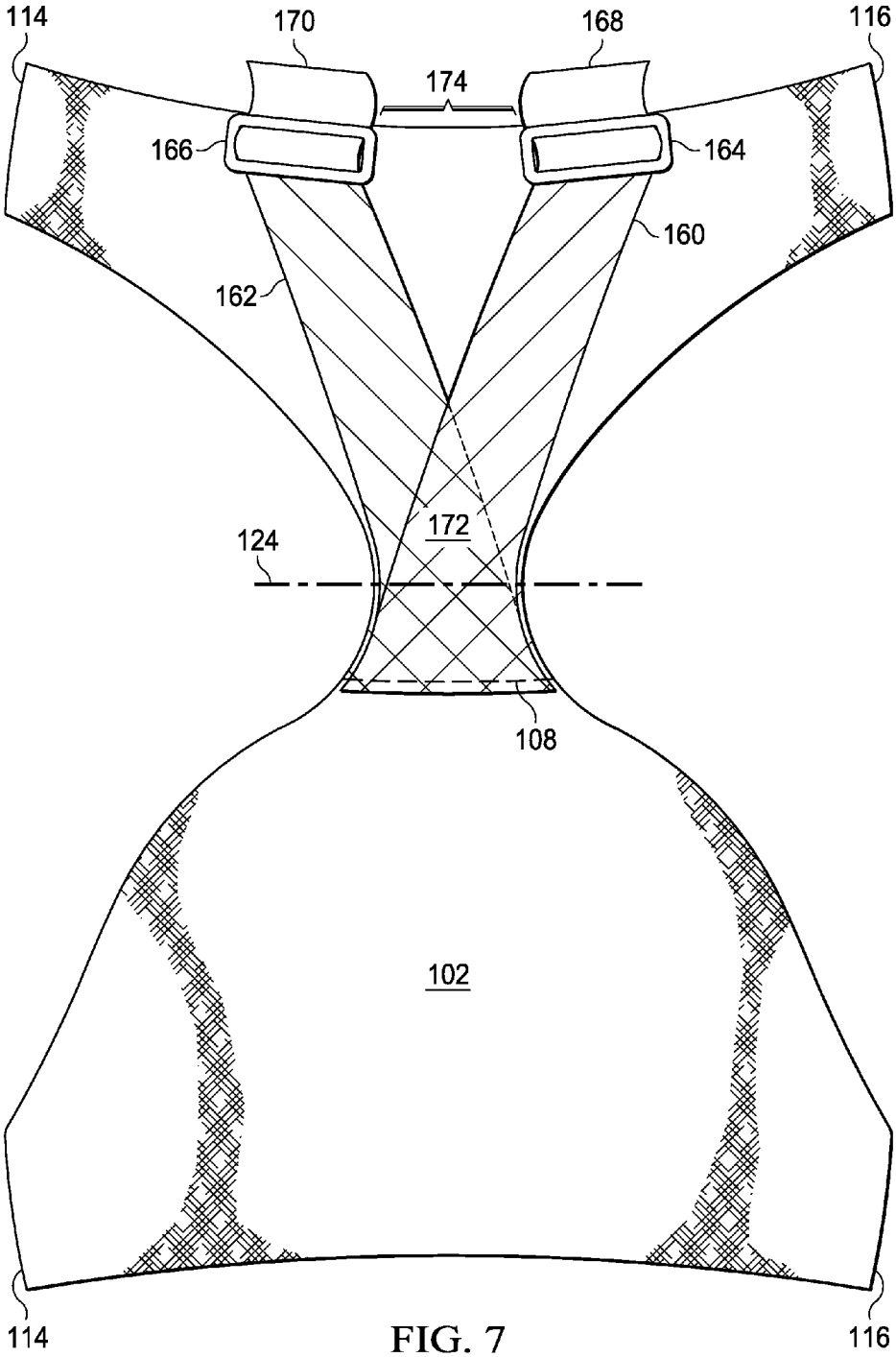
FIG. 7 is an embodiment of an undergarment depicting two elastomeric layers with an adjustable connection.

FIG. 7 depicts another embodiment of the undergarment 102 in a flat layout for illustrative purposes. As discussed with FIG. 3, sides 114 and 116 are shown at corresponding locations on the top and bottom of the flat layout of the undergarment 102 to illustrate the locations where the sides 114 and 116 would be connected to form undergarment 102.

In this embodiment, the tension layer comprises a first tension component 160 and a second tension component 162. Tension components 160 and 162 are each shown with different markings to better illustrate the layout of each of tension component 160 and 162. In addition, overlap portion 172 is shown with the both sets of markings to illustrate the area in which the tension components 160 and 162 cross each other. In some embodiments, a gap area 174 exists between tension components 160 and 162, and does not include any tension element. In this embodiment, the primary area of the overlap portion 172 is designed to correspond to the wearer's crotch. For example, when worn by a woman, the overlap portion 172 would be designed to cover the labia of the woman in order to focus the pressure at the desired location to conceal, obfuscate and/or eliminate any view of the curvature of the woman's labia. In some embodiments, the overlap portion may only cover a portion of the woman's labia. One skilled in the art will recognize that one design of undergarment 102 may operate, affect or be worn differently by different women due to a variety of characteristics associated with each woman's body type. Elements of this disclosure may be varied to create a series of garments to correspond to various body types, in order to provide users with the options to select garments best suited for that user's body type.

In this embodiment, first tension component 160 is attached along the front at the top with first adjustable connection 164 and second tension component 162 is attached along the front at the top with second adjustable connection 166 and both tension components 160 and 162 are attached along the base at bottom connection 108. As discussed further above, embodiments may be attached and/or integrated with a variety of techniques and components and remain within the scope and spirit of the disclosure. Embodiments of the present disclosure may incorporate one or more types, systems, materials, components or other connections for attaching the disclosed components. For example, bottom connection 108 may comprise a seam while adjustable connections 164 and 166 may comprise friction connections.

In this embodiment, adjustable connections 164 and 166 can be used to provide adjustable tension on each of tension components 160 and 162. Adjacent to the top of undergarment 102, first tension component 160 includes a first tab 168 and second tension component 162 includes a second tab 170. In some embodiments, tabs 168 and 170 are the same material as tension components 160 and 162. In some embodiments, tabs 168 and 170 comprise different materials from tension components 160 and 162, and are connected to or integrated with the tension components 160 and 162. For example, tabs 168 and 170 may comprise a silicone, gel, rubber and/or other materials which increase the friction coefficient. In some embodiments, tabs 168 and 170 may comprise combinations of components which may affect the elasticity, friction coefficient, comfort, production cost, aesthetic appearance and/or other characteristics which may be associated with tabs 168 and 170. For example, tabs 168 and 170 may comprise a section of tension components 160 and 162 with deposits of materials to increase friction attributes of the tension components 160 and 162. As another example, tabs 168 and 170 may comprise a section of tension components 160 and 162 with materials to increase friction attributes interwoven with the material of tension components 160 and 162. One skilled in the art will recognize that the design, manufacture, materials and/or other characteristics of the tabs 168 and 170 may vary and remain within the scope and spirit of the present disclosure.

In this embodiment, the adjustable connections 164 and 166 are depicted as slip-lock buckles which provide friction connections with tabs 168 and 170. Tabs 168 and 170 are each pulled through the slip-lock buckles of adjustable connections 164 and 166 to create a friction connection between the material of the tabs 168 and 170 and slip-lock buckle. In some embodiments, elements of one or more components may create a tensioning effect to increase the friction coefficient between the tabs 168 and 170 and slip-lock buckle of adjustable connections 164 and 166.

In this embodiment, the tension in tension components 160 and 162 may be adjusted using the tabs 168 and 170. For example, a user may increase the tension in one or more of tension components 160 and 162 by pulling tab 168 or 170 through the corresponding adjustable connection 164 or 166 thereby shortening the amount of material comprising the tension component 160 or 162 between bottom connection 108 and the top of undergarment 102. The shortened amount of material of tension component 160 or 162 causes the tension component 160 or 162 to stretch further when worn increasing the pressure on the wearer. The interaction of the tabs 168 and 170 with the adjustable connections 164 and 166 creates sufficient friction to maintain the engagement of tabs 168 and 170 with the adjustable connections 164 and 166 during use. In some embodiments, a user may also decrease the tension in tension components 160 and 162 by pulling the tab 168 or 170 in the opposite direction to lengthen the amount of material comprising the tension component 160 or 162 between bottom connection 108 and the top of undergarment 102.

One skilled in the art will recognize that the tabs 168 and 170 and slip-lock buckles of the adjustable connections 164 and 166 may be varied to alter various characteristics of adjustable connections 164 and 166 and/or the tension components 160 and 162. Characteristics of the adjustable connections 164 and 166 may include adjustment scope, thresholds, sensitivity, comfort, concealment, direction and other characteristics. In some embodiments, adjustable connections 164 and 166 may be designed from a soft gel material which creates a high friction coefficient with a corresponding gel material associated with tabs 168 and 170. In some embodiments, the soft gel material may be incorporated along the entire waistband of the undergarment 102 to improve the aesthetic look of the undergarment 102 by minimizing the likelihood that the adjustable connections 164 and 166 are noticeable. In addition, a gel waistband may prevent or limit the likelihood that the waistband will shift during use due to movement and/or additional tension against the waistband created by the tension components 160 and 162. In some embodiments, undergarment 102 may include a pocket or other mechanism to hold the section of tabs 168 and 170 extending above the waistband such that the tabs 168 and 170 do not visibly extend beyond the top of undergarment 102.

In some embodiments, adjustable connections 164 and 166 comprise alternative features to facilitate an adjustable connection along the top of undergarment 102. For example, tabs 168 and 170 may comprise one portion of hook-and-loop tape and adjustable connections 164 and 166 may comprise the corresponding portion of hook-and-loop tape. As another example, adjustable connections 164 and 166 may comprise one or more teeth angled toward the top edge of undergarment 102 wherein the tension components 160 and 162 cause tabs 168 and 170 to engage the teeth. In such an embodiment, the adjustable connections 164 and 166 may allow the tension to be increased, but limit the capability to reduce tension.

One skilled in the art will recognize that the adjustable connections 164 and 166 and corresponding components, if needed, may vary in operation, design, material and other aspects and remain within the scope and spirit of the present disclosure. In addition, some embodiments may include additional adjustment capabilities to vary aspects of the tension components and allow personalization of the design to best fit a user's purposes. For example, adjustable connections 164 and 166 may facilitate horizontal adjustments to allow the direction of tension to be altered. As another example, each tension component 160 and 162 may comprise multiple tension components which may independently be adjusted to create a preferred combination of comfort and obfuscation of the wearer's privates. One skilled in the art will recognize that adjustable connections may be implemented at alternative locations to provide capability for adjusting tension, direction and/or other characteristics associated with the components of the present disclosure. For example, one or more adjustable connections may be located at bottom connection 108 to modify the tension components 160 and 162 from the bottom of undergarment 102.

In the embodiment shown, first tension component 160 extends from the first adjustable connection 164 to the left side of bottom connection 108. Second tension component 162 extends from the second adjustable connection 166 to the right side of bottom connection 108. The two tension components cross each other in overlap portion 172. In some embodiments, tension components 160 and 162 do not overlap along the top of undergarment 102 creating gap area 174. One skilled in the art will recognize that that the size, shape and other characteristics of the tension components 160 and 162 may vary and remain within the scope and spirit of the present disclosure.

In this embodiment, center line 124 illustrates the center of the bottom of undergarment 102. Bottom connection 108 is located below center line 124 in this embodiment. When undergarment 102 is worn, the tension components 160 and 162 extend from behind center line 124 to the waist line of the undergarment 102. In such embodiments, the design may provide more upward pressure against the wearer's crotch for support. One skilled in the art will recognize that the location of bottom connection 108 and/or adjustable connections 164 and 166 may vary and effect the scope, focus, location, extent and/or other characteristic associated with the pressure created by the tension layer.

As discussed above, aesthetic characteristics associated with the design of the undergarment 102 may also influence the location and/or type of connection utilized. As disclosed further herein, the design and characteristics of the tension layer and/or other components may be varied to account for a variety of considerations including the aesthetic factors.

Figure 8:
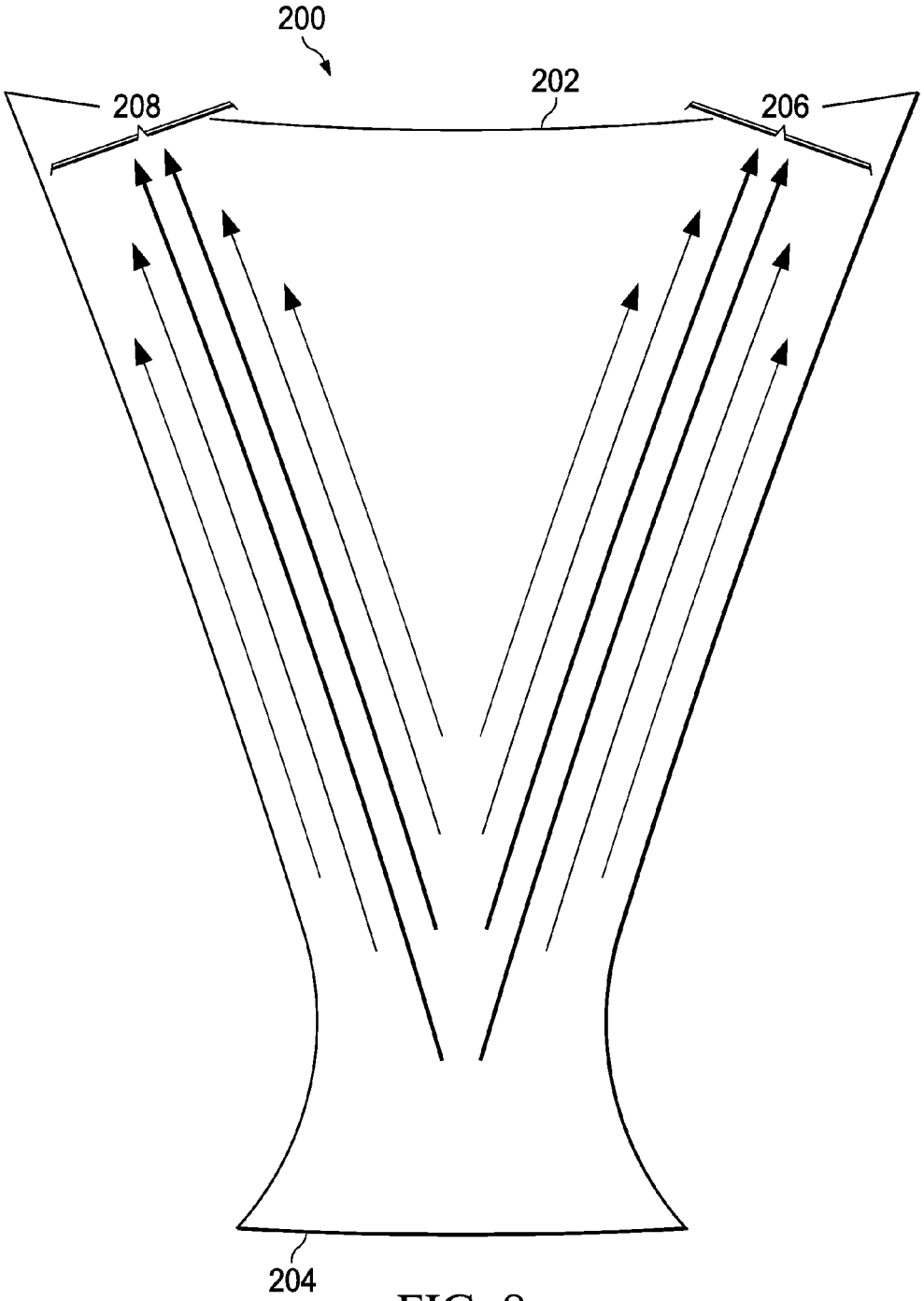
FIG. 8 is a diagram depicting variations in tension through the material.

FIG. 8 depicts an illustrative embodiment of a tension layer 200. Tension layer 200 is shown with top 202 and bottom 204. In some embodiments, the top 202 will correspond to the front waist band of a garment, and the bottom 204 will correspond approximately to the center or bottom of the crotch of the garment. In this embodiment, the tension layer 200 depicts a first tension section 206 and a second tension section 208. Tension sections 206 and 208 each show a group of arrows extending in different diagonal directions to illustrate direction of tension in this embodiment of the tension layer 200. In the embodiment shown, the tension sections 206 and 208 cross at approximately a 35 degree angle creating a cross-directional pressure at the area in with the tension sections 206 and 208 cross or overlap. The angle at which the tension sections 206 and 208 cross may vary and remain within the scope and spirit of the present disclosure. In some embodiments, the tension sections 206 and 208 may not provide crossing tension attributes. For example, the tension section 206 and 208 may provide parallel tension. As another example, the tension may be applied to a non-elastic material whereby the tension elements do not cross, but the direction of tension may cross in the non-elastic material. Tension layer 200 may include multiple tension sections at a variety of strengths and directions. For example, some embodiments may include another tension section directed vertically from bottom 204 towards top 202.

The tension sections 206 and 208 in FIG. 8 further illustrate the level of tension through the depiction of the length of each arrow and the boldness of the central arrow. This embodiment accordingly depicts the tension increasing towards the middle of each of tension sections 206 and 208. The levels of tension along different areas of the tension layer 200 may vary for a number of reasons. For example, embodiments may include lower tension areas along the outer edges to prevent the edges from cutting, pressing or otherwise creating discomfort for the wearer. As another example, embodiments may be designed to provide crossing pressure characteristics which may be preferred by a wearer for comfort, obfuscation, and/or aesthetics.

One skilled in the art will recognize that tension layer 200 is provided for illustrative purposes and may be varied. For example, as discussed further with respect to other figures, tension layer 200 may be comprised of one or more tension components or other elements of garments. In addition, the design, manufacture, materials, tension, comfort, function and/or other characteristics of the tension layer may vary.

As discussed further herein, one or more tension layers 200 may be incorporated into a garment. The styles, types, designs and/or functions of the garment may vary and remain within the scope and spirit of the disclosure. In some embodiments, the tension layer 200 is designed to correspond to the wearer's crotch. For example, when worn by a woman, the tension layer 200 would be designed to cover the labia of the woman in order to focus the pressure at the desired location to conceal, obfuscate and/or eliminate any view of the curvature of the woman's labia. In some embodiments, the tension layer 200 may only cover a portion of the woman's labia. One skilled in the art will recognize that one design of tension layer 200 may operate, affect or be worn differently by different women due to a variety of characteristics associated with each woman's body type. Elements of this disclosure may be varied to create a series of garments to correspond to various body types, in order to provide each user with the option to select garments best suited for that user's body type.

As discussed further above, embodiments of tension layer 200 may be attached and/or integrated with a garment using a variety of techniques and components and remain within the scope and spirit of the disclosure. Embodiments of the present disclosure may incorporate one or more types, systems, materials, components or other connections for attaching the disclosed components.

The extent and location of the pressure created by tension layer 200 may be influenced by a variety of factors including means and location of connections to a garment and characteristics of the tension layer 200, such as dimensions, materials, designs and other characteristics. Materials may be designed to have a variety of elastomeric properties associated with various portions of the tension component whereby the pressure created may be directed to specific locations. In some embodiments, tension layer 200 may be weaved with multiple fabrics having differing elastomeric properties. For example, in order to increase the tension in a vertical direction the upper portion of tension layer 200 may include fabrics with more elasticity than the fabrics used in lower portion of tension layer 200. In addition, fabrics may provide differing elasticity in a horizontal direction.

In addition to the variety of elastomeric properties, the tension layer 200, a liner and/or garment may be designed from specific fabrics, materials and/or combinations thereof to provide additional characteristics which may be desired. For example, some materials may be incorporated to provide comfort, breathability, moisture absorption, odor absorption, feminine hygiene, and/or other characteristics. Materials used in the design of the garments, tension components and/or liners may include cottons, nylons, polyesters, DAZZLE® fabrics, silk, rubbers, elastics, neoprene, spandex, other synthetic and natural materials and combinations of materials. The various components may also include other design elements such as mesh designs, moisture control designs, breathable weaves, weaves for improving obfuscation, layering designs, other designs and combinations of design features. One skilled in the art will recognize that the various elements, features, designs and materials of tension component 200 and other components discussed in connection of one or more embodiments herein may be incorporated into various garments according to the present disclosure. The selection of materials and/or features of the various layers may be designed to prevent curling of fabrics along the edges of the components.

Figure 9:
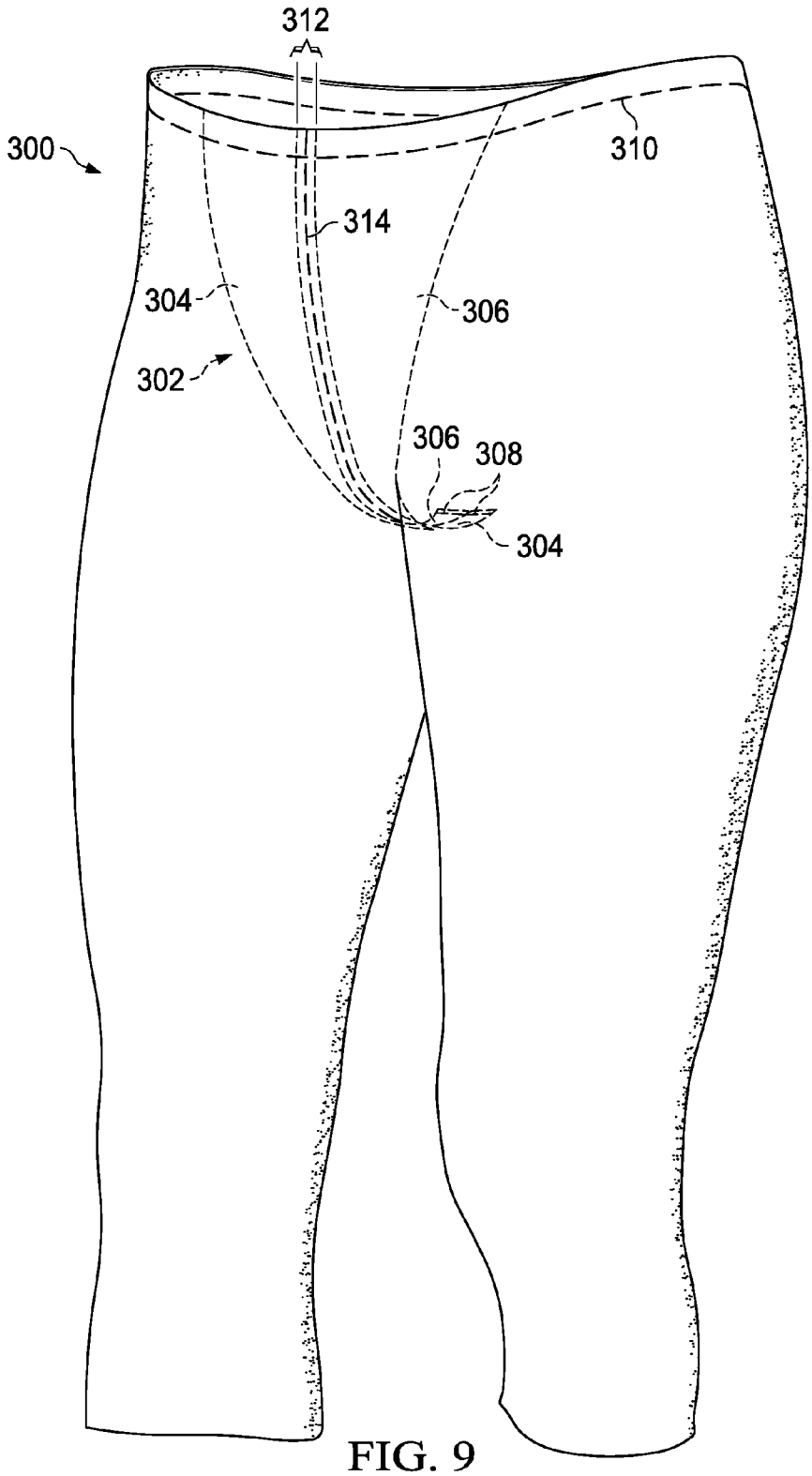
FIG. 9 is an embodiment of pants including two elastomeric layers.

FIG. 9 depicts an embodiment of garment 300 with a privacy control feature 302. One skilled in the art will recognize that the garment 300 and privacy control feature 302 may vary in design, materials and/or style and remain within the scope and spirit of the present disclosure. For example, garment 300 may comprise any style of pant design, such as jeans, capris, shorts, yoga pants, pajama bottoms, slacks and other styles. In addition, design elements may vary and remain within the scope and spirit of the present disclosure. For example, seam 314 is shown vertically in approximately the center of the garment 300 in this embodiment, however, the location and/or type of the seam 314 may be altered or the seam 314 may be eliminated completely.

In this embodiment, privacy control feature 302 includes a tension layer proximate to the crotch of a person. The tension layer of this embodiment comprises a first tension component 304 and a second tension component 306. In some embodiments, garment 300 may include a liner covering tension components 304 and 306 in whole or in part. Each of the tension components 304 and 306 are attached along the top of the garment 300 at top connection 310 and attached at the base of the crotch of garment 300 at bottom connection 308. One skilled in the art will recognize that the top connection 310 and/or bottom connection 308 may vary and effect the scope, focus, location, extent and/or other characteristic associated with the pressure created by the tension layer. For example, the top connection 310 may be a dropped waistband located a portion of the way down from the top of the garment 300 based upon design features of the garment 300. In some embodiments, the top connection 310 may be located approximately two to three inches from the top of the garment 300. Top connection 310 and bottom connection 308 may comprise any one or more manners for attaching the tension components 304 and 306 to the garment 300. For example, bottom connection 308 may comprise a stitched seam and top connection 310 may comprise an adhesive. In some embodiments, the privacy control feature 302 may be attached such that it is removable and replaceable. In such embodiments, a user may have a series of garments which may be operatively engageable or attachable with one or more privacy control features 302. In some embodiments, the privacy control feature 302 may attach to the garment 300 along the outside borders (closest to the wearer's legs) of the tension components 304 and 306, appearing to make the shape of an inverted triangle.

In some embodiments, privacy control feature 302 may include fabric layers encasing the tension layer. For example, a removable privacy control feature 302 may comprise the tension layer encased between two liners which are sewn, zipped, adhered or otherwise connected to each other along the edges. The tension layer may be connected to the top and bottom edges of the liners, but otherwise freely movable within the encasement created by the two liners. At the top and bottom edges of the liners, the privacy control feature may include connection components to facilitate a removable connection with a corresponding garment. The design of the encasement, connection components and/or removable privacy control feature may vary and remain within the scope and spirit of the present disclosure.

In some embodiments, tension components 304 and 306 cross each other such that an increased level of support is provided around a desired location wherein tension components 304 and 306 overlap. Overlap portion 312 shows the overlap in the front of the tension layer of privacy control feature 302. In some embodiments, the tension layer is utilized to conceal, eliminate and/or obfuscate the external portion of a woman's genitalia when the garment 300 is worn. When worn, the tension components 304 and 306 help flatten the fatty tissue of a woman's front pelvic area by applying a comfortable amount of tension and compressing that tissue against the woman's body, thereby concealing, obfuscating and/or preventing the appearance of this tissue from protruding outward and the curvature being visible through garment 300.

One skilled in the art will recognize that garment 300 may be worn in conjunction with other garments and undergarments For example, a woman may wear a pair of panties under garment 300 which would provide an additional layer between the privacy control feature 302 and the woman's labia.

When a woman is wearing garment 300, tension component 306 extends from one side of bottom connection 308 diagonally to the opposite side of top connection 310 and is operatively engaged with the crotch of the woman to provide a pressure against the external portion of the woman's genitalia. In addition, tension component 304 extends from the other side of bottom connection 308 diagonally to the opposite side of top connection 310 crossing over tension component 306 and is operatively engaged with the crotch of the woman to provide a pressure against the external portion of the woman's genitalia. The overlap portion 312 may be designed to cover the woman's labia such that a combined pressure created by each of tension components 304 and 306 is applicable to at least a portion of the woman's labia. In some embodiments, the overlap portion 312 is designed to cover the woman's labia completely.

In some embodiments, the pressure from tension components 304 and 306 is in an upward direction to lift the labia and conceal, eliminate and/or obfuscate any visible curvature of the female anatomy. In some embodiments, the pressure from tension components 304 and 306 is in a direction towards the woman's back to conceal, eliminate and/or obfuscate any visible curvature of the female anatomy. The pressure may be directed in one or more directions, such as upward, inward, outward, towards the woman's back and/or combinations thereof, to create pressure against a woman's body in order to conceal, eliminate and/or obfuscate any visible curvature of the female anatomy. One skilled in the art will recognize that the direction of pressure created by the tension layer may vary while operating to conceal, eliminate and/or obfuscate any visible curvature of the female anatomy.

Embodiments of undergarments with tension layers may be designed to fit different sizes and shapes of the various wearers. In addition, the extent and location of pressure provided by the tension layer may vary in different embodiments. In some embodiments, the garment 300 in conjunction with the tension components 304 and 306 may be designed to fit differing body types through the extent, location, size and other characteristics of the tension components. In some embodiments, the garment 300 in conjunction with the tension components 304 and 306 may be designed to compliment another garment to wear over or under garment 300. One skilled in the art will recognize that the number of tension layers and/or tension components within a tension layer may vary and remain within the scope and spirit of the present disclosure.

Figure 10:
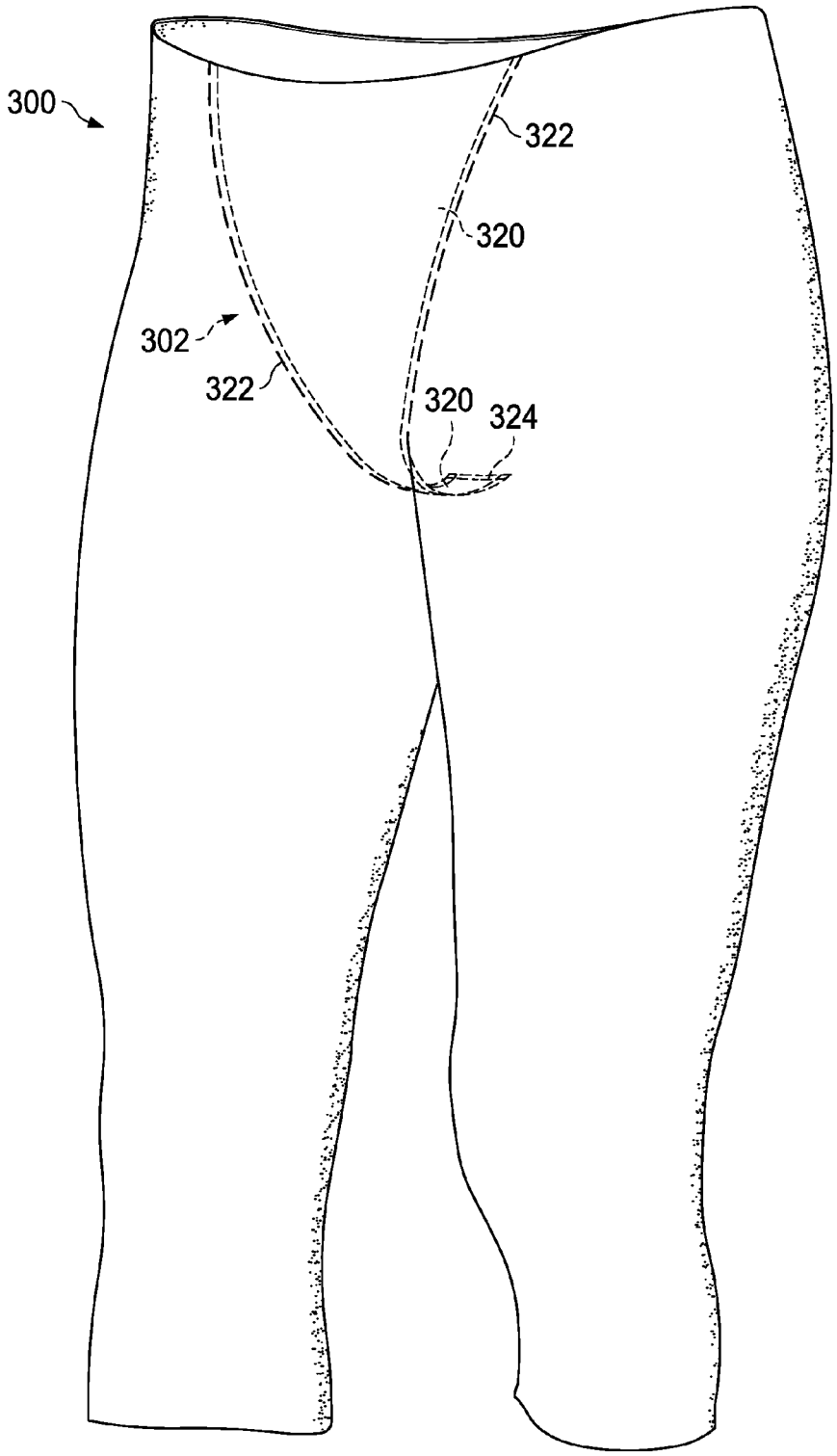
FIG. 10 is another embodiment of pants including a single elastomeric layer.

FIG. 10 depicts an embodiment of garment 300 with a privacy control feature 302. One skilled in the art will recognize that the garment 300 and privacy control feature 302 may vary in design, materials and/or style and remain within the scope and spirit of the present disclosure. For example, garment 300 may comprise any style of pant design, such as jeans, capris, shorts, yoga pants, pajama bottoms, slacks and other styles. In addition, design elements may vary and remain within the scope and spirit of the present disclosure. For example, seams 322 are shown diagonally narrowing towards the bottom of the crotch in approximately the center of the garment 300 in this embodiment, however, the location and/or type of the seams 322 may be altered.

In this embodiment, privacy control feature 302 includes a tension layer proximate to the crotch of a person. In this embodiment, the tension layer comprises a tension component 320. In some embodiments, garment 300 may include a liner covering tension component 320 in whole or in part. Tension component 320 may perform the same functions as multiple tension components. One skilled in the art will recognize that one or more tension components may be utilized in embodiments of the disclosure. In some embodiments, tension component 320 may provide a constant tension characteristic across the entirety of the tension component 320. For example, tension component 320 may comprise a single elastomeric fabric which provides a constant tension throughout the material.

In some embodiments, the tension component 320 is designed to provide a variety of tension characteristics at locations through the fabric. For example, tension component 320 may be constructed to provide more tension at desired locations, such as the anticipated area proximate to the wearer's labia, and lower levels of tension at other locations, such as the edge of the tension component 320. For another example, the tension component 320 may be constructed to focus tension in desired directions, such as crossing angular directions. When providing crossing angular tension, the area in which the tension crosses may comprise the area of focused tension associated with the wearer's crotch. The design of the materials, dimensions, tension and other characteristics of tension component 320 may be varied to conceal, obfuscate or eliminate the curvature of the wearer's body. The tension component 320 may be controlled, influenced, or modified through fabric design methods including weaving, material selection, layering, tension modification techniques and/or other means of influencing the tension characteristics.

When worn by a woman, the tension component 320 and/or an active or selected portion of tension component 320 would be designed to cover the labia of the woman in order to focus the pressure at the desired location to conceal, obfuscate and/or eliminate any view of the curvature of the woman's labia. One skilled in the art will recognize that one design of garment 300 may operate, affect or be worn differently by different women due to a variety of characteristics associated with each woman's body type. Elements of this disclosure may be varied to create a series of garments to correspond to various body types, in order to provide users with the options to select garments best suited for that user's body type.

In this embodiment, tension component 320 is attached along the front at the top waist line and along the base at bottom connection 324. Bottom connection 324 may comprise any one or more manners for attaching the tension component 320 to the garment 300. For example, bottom connection 324 may comprise a stitched seam and an adhesive. In some embodiments, the privacy control feature 302 may be attached such that it is removable and replaceable. In such embodiments, a user may have a series of garments which may be operatively engageable or attachable with one or more privacy control features 302. In the embodiment shown, tension component 320 is wider along the top than it is along bottom connection 324. In some embodiments, the tension component 320 is a rectangular strip of material. One skilled in the art will recognize that that the size, shape and other characteristics of the tension component 320 may vary and remain within the scope and spirit of the present disclosure.

One skilled in the art will recognize that garment 300 may be worn in conjunction with other garments and undergarments. For example, a woman may wear a pair of panties under garment 300 which would provide an additional layer between the privacy control feature 302 and the woman's labia. Different garments 300 may be designed for either wearing or not wearing additional garments over the crotch. For example, a woman may elect to purchase yoga pants to wear without panties to avoid undesired panty lines. The privacy control feature 302 in conjunction with the material of the yoga pants may be breathable and comfortable materials designed to wick away moisture to maintain further comfort during an exercise class. For example, the material may comprise a wide mesh design for the tension component 320 of the privacy control feature 302 while the garment 300 uses a tight but breathable fabric to prevent a see-through effect which wider mesh may allow.

In some embodiments, the pressure from tension component 320 is in an upward direction to lift the labia and conceal, eliminate and/or obfuscate any visible curvature of the female anatomy. In some embodiments, the pressure from tension component 320 is in a direction towards the woman's back to conceal, eliminate and/or obfuscate any visible curvature of the female anatomy. The pressure may be directed in one or more directions, such as upward, inward, outward, towards the woman's back and/or combinations thereof, to create pressure against a woman's body in order to conceal, eliminate and/or obfuscate any visible curvature of the female anatomy. One skilled in the art will recognize that the direction of pressure created by the tension layer may vary while operating to conceal, eliminate and/or obfuscate any visible curvature of the female anatomy.

Embodiments of garments with tension layers may be designed to fit different sizes and shapes of the various wearers. In addition, the extent and location of pressure provided by the tension layer may vary in different embodiments. In some embodiments, the garment 300 in conjunction with the tension component 320 may be designed to fit differing body types through the extent, location, size and other characteristics of the tension components. In some embodiments, the garment 300 in conjunction with the tension component 320 may be designed to compliment another garment to wear over or under garment 300. One skilled in the art will recognize that the number of tension layers and/or tension components within a tension layer may vary and remain within the scope and spirit of the present disclosure.

In some embodiments, the garment 300 conceals, obfuscates or eliminates the curvature of the wearer's body in part or in whole through the design of the seams 322 which are shown diagonally narrowing towards the bottom of the crotch in approximately the center of the garment 300. For example, the angular design of the seams 322 avoids a centered seam line which may accentuate the visible curvature of the female anatomy by creating pressure which may induce spreading or separating of the woman's labia. Instead, the angular design of the seams 322 may be used to create pressure across the woman's labia and prevent the undesired accentuation of the visible curvature of the female anatomy.

In some embodiments, the material between the seams 322 may be designed with increased tension in proximity to the anticipated location of a woman's labia to further conceal, obfuscate or eliminate the curvature of the wearer's body. For example, the tension component 320 may attach to the seams 322 to create tension across the anticipated area of the woman's labia. In some embodiments, the tension component 320 stretched between the seams 322 may only cover the area proximate to a wearer's genitalia and may not extend to the top of garment 300.

Some embodiments of the garment 300 may incorporate the tension component 320 into the material of the garment 300 between the seams 322. In such embodiments, the material incorporating the tension component 320 may operate as the exterior and interior surface of the garment 300 in the area between the seams 322. In some embodiments, the material may be designed to provide an external surface with a look, texture and/or other characteristic consistent with the remainder of the garment 300, and to provide an interior surface with tension and liner characteristics proximate to the crotch of the wearer. Embodiments of the material with different surface characteristics may be created through design of the weave of one or more fabrics or materials, the composition of the materials and/or other design techniques.

In some embodiments, the angular design of the seams 322 may provide sufficient pressure with the material of the garment 300 to conceal, obfuscate or eliminate the curvature of the wearer's body. In such embodiments of the garment 300 may not include a special or independent tension component 320. For example, a pair of pants with the angular seams 322 may use the same material (such as cotton, nylon, polyesters, DAZZLE® fabric, silk, etc.) for the entirety of the garment 300, including the area between the seams 322. The tension of the material used between the seams 322 may create sufficient pressure and lift to conceal, obfuscate or eliminate the curvature of the body when worn by a woman.

In some embodiments, the seams 322 may extend past the bottom connection 324 shown in the current embodiment to the top of the garment in the back. In some such embodiments, the angular design of the seams 322 may continue to the connection at the top of the back of the garment 300 eliminating a central seam along the back of the garment 300. Angular seams in the back of the garment 300 may minimize the curvature of the wearer's gluteus muscles sometimes accentuated by central seams which are vertically between the gluteus muscles.

In some embodiments, the seams 322 may be designed at angles which mimic a seam or edge of another garment to conceal, obfuscate or eliminate the appearance of whichever garment is worn as the undergarment. For example, garment 300 may be a pair of tights worn under a leotard for dancing. The angle of the seams 322 in the garment 300 may approximate the angle of the outer edge of the leotard to avoid any unwanted lines being visible in the center of the outfit.

Figure 11:
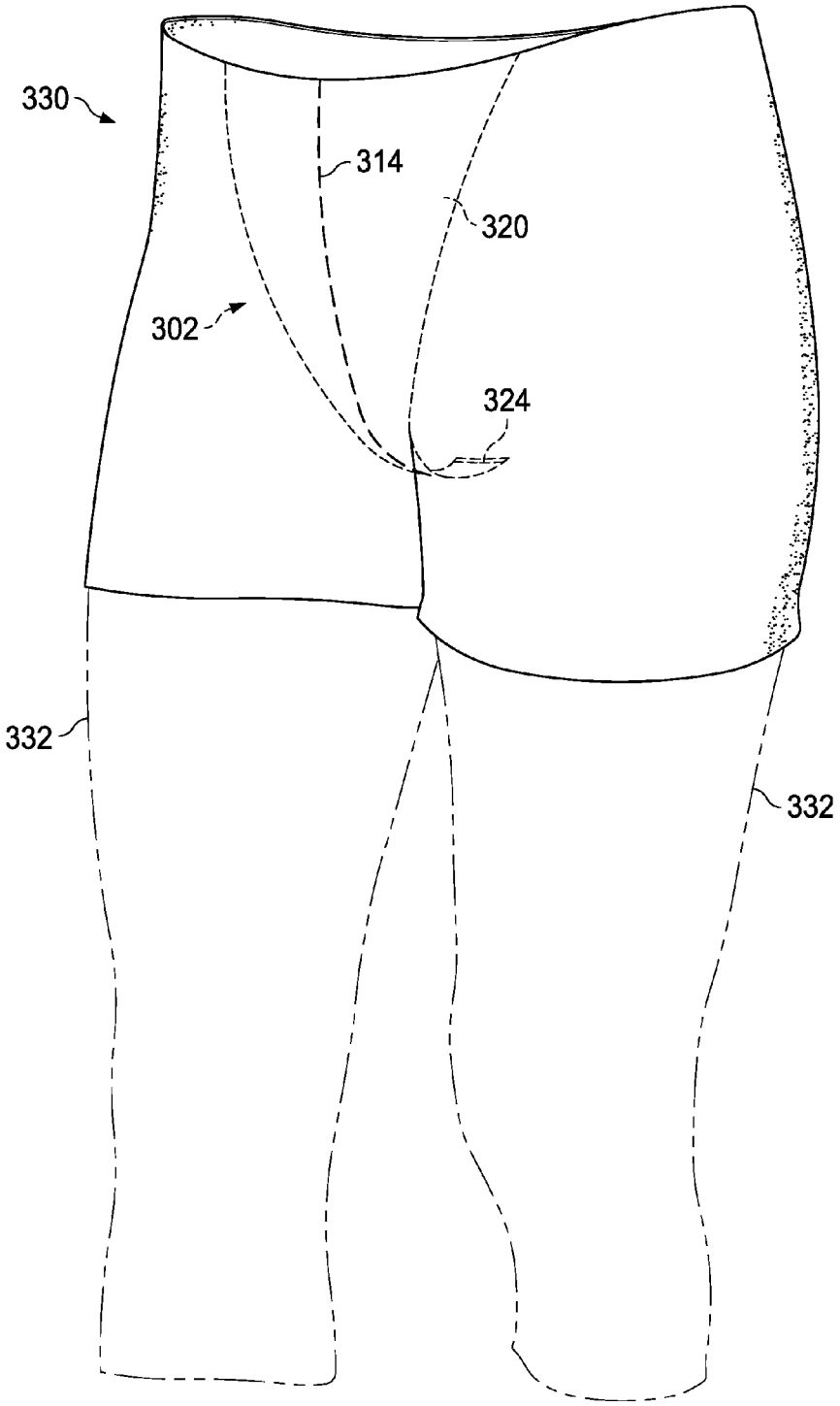
FIG. 11 is an embodiment of shorts including an elastomeric layer.

FIG. 11 depicts an embodiment of garment 330 with a privacy control feature 302 worn by a person. In this embodiment, garment 330 comprises a pair of shorts. In some embodiments, the garment 330 may comprise other types of garments or undergarments such as, compression-wear, boyshorts, etc. The legs 332 of the person are shown for context. One skilled in the art will recognize that the garment 330 and privacy control feature 302 may vary in design, materials and/or style and remain within the scope and spirit of the present disclosure. In addition, design elements may vary and remain within the scope and spirit of the present disclosure. For example, seam 314 is shown vertically in approximately the center of the garment 330 in this embodiment, however, the location and/or type of the seam 314 may be altered or eliminated all together.

In this embodiment, privacy control feature 302 includes a tension layer proximate to the crotch of a person. In this embodiment, the tension layer comprises a tension component 320. In some embodiments, garment 330 may include a liner covering tension component 320 in whole or in part. Tension component 320 may perform the same functions as multiple tension components. One skilled in the art will recognize that one or more tension components may be utilized in embodiments of the disclosure. In some embodiments, tension component 320 may provide a constant tension characteristic across the entirety of the tension component 320.

For example, tension component 320 may comprise a single elastomeric fabric which provides a constant tension throughout the material.

In some embodiments, the tension component 320 is designed to provide a variety of tension characteristics at locations through the fabric. For example, tension component 320 may be constructed to provide more tension at desired locations, such as the anticipated area proximate to the wearer's labia, and lower levels of tension at other locations, such as the edge of the tension component 320. For another example, the tension component 320 may be constructed to focus tension in desired directions, such as crossing angular directions. When providing crossing angular tension, the area in which the tension crosses may comprise the area of focused tension associated with the wearer's crotch. The design of the materials, dimensions, tension and other characteristics of tension component 320 may be varied to conceal, obfuscate or eliminate the curvature of the wearer's body. The tension component 320 may be controlled, influenced, or modified through fabric design methods including weaving, material selection, layering, tension modification techniques and/or other means of influencing the tension characteristics.

When worn by a woman, the tension component 320 and/or an active or selected portion of tension component 320 would be designed to cover the labia of the woman in order to focus the pressure at the desired location to conceal, obfuscate and/or eliminate any view of the curvature of the woman's labia. One skilled in the art will recognize that one design of garment 330 may operate, affect or be worn differently by different women due to a variety of characteristics associated with each woman's body type. Elements of this disclosure may be varied to create a series of garments to correspond to various body types, in order to provide users with the options to select garments best suited for that user's body type.

In this embodiment, tension component 320 is attached along the front at the top waist line and along the base at bottom connection 324. In some embodiments, the tension component 320 may be attached along the front at a location dropped below the top waist line. For example, the tension component 320 may be attached to a seam dropped between 0.5 and 4 inches from the top waist line. Bottom connection 324 may comprise any one or more manners for attaching the tension component 320 to the garment 330. For example, bottom connection 324 may comprise a stitched seam and an adhesive. In some embodiments, the privacy control feature 302 may be attached such that it is removable and replaceable. In such embodiments, a user may have a series of garments which may be operatively engageable or attachable with one or more privacy control features 302. In the embodiment shown, tension component 320 is wider along the top than it is along bottom connection 324. In some embodiments, the tension component 320 is a rectangular strip of material. One skilled in the art will recognize that that the size, shape and other characteristics of the tension component 320 may vary and remain within the scope and spirit of the present disclosure.

One skilled in the art will recognize that garment 330 may be worn in conjunction with other garments and undergarments. For example, a woman may wear a pair of panties under garment 330 which would provide an additional layer between the privacy control feature 302 and the woman's labia. Different garments 330 may be designed for either wearing or not wearing additional garments. For example, a woman may elect to purchase workout shorts to wear without panties to avoid undesired panty lines. The privacy control feature 302 in conjunction with the material of the shorts may be breathable and comfortable materials designed to wick away moisture to maintain further comfort during an exercise class. For example, the material may comprise a mesh design for the tension component 320 of the privacy control feature 302 while the garment 330 uses a tight but breathable fabric to prevent a see-through effect which the mesh may allow.

In some embodiments, the pressure from tension component 320 is in an upward direction to lift the labia and conceal, eliminate and/or obfuscate any visible curvature of the female anatomy. In some embodiments, the pressure from tension component 320 is in a direction towards the woman's back to conceal, eliminate and/or obfuscate any visible curvature of the female anatomy. The pressure may be directed in one or more directions, such as upward, inward, outward, towards the woman's back and/or combinations thereof, to create pressure against a woman's body in order to conceal, eliminate and/or obfuscate any visible curvature of the female anatomy. One skilled in the art will recognize that the direction of pressure created by the tension layer may vary while operating to conceal, eliminate and/or obfuscate any visible curvature of the female anatomy.

Embodiments of garments with tension layers may be designed to fit different sizes and shapes of the various wearers. In addition, the extent and location of pressure provided by the tension layer may vary in different embodiments. In some embodiments, the garment 330 in conjunction with the tension component 320 may be designed to fit differing body types through the extent, location, size and other characteristics of the tension components. In some embodiments, the garment 300 in conjunction with the tension component 320 may be designed to compliment another garment to wear over or under garment 330. One skilled in the art will recognize that the number of tension layers and/or tension components within a tension layer may vary and remain within the scope and spirit of the present disclosure.

Figure 12:
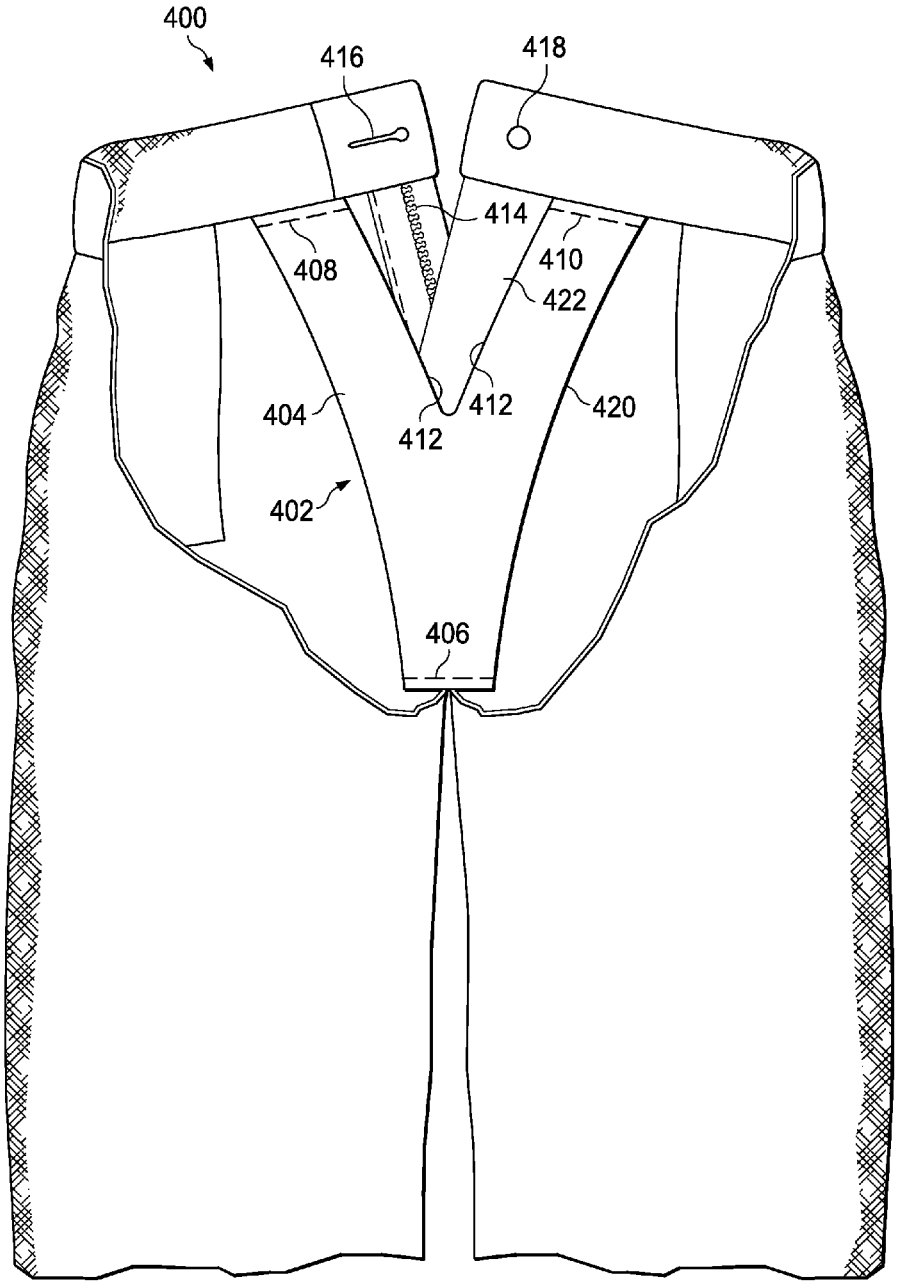
FIG. 12 is another embodiment of pants including an open zipper and a single elastomeric layer.
Figure 13:
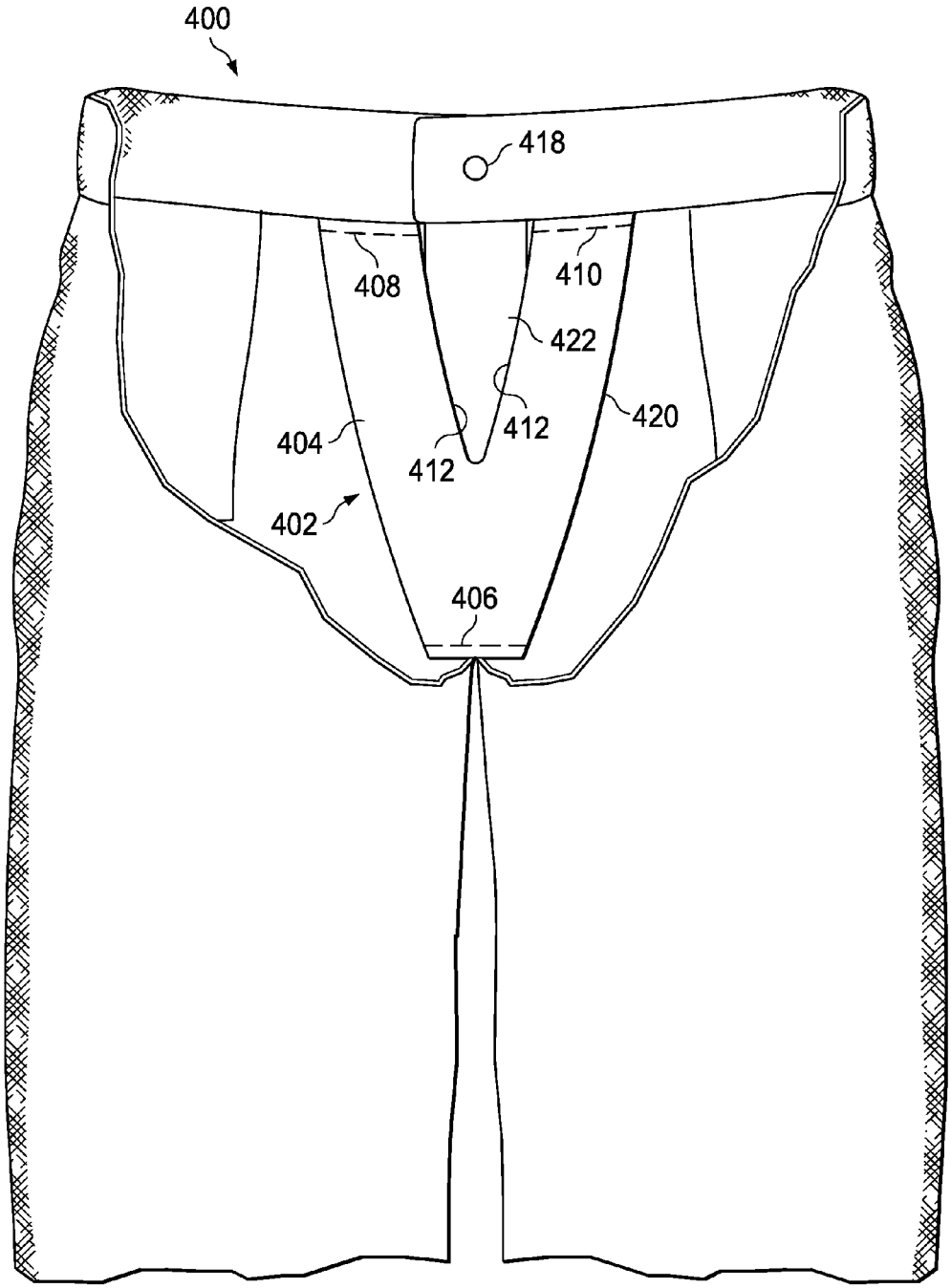
FIG. 13 is another embodiment of pants including a closed zipper and a single elastomeric layer.

FIGS. 12 and 13 depict an embodiment of garment 400 having a zipper 414. The garment 400 is shown without the rear portion in order to illustrate a privacy control feature 402. FIG. 12 depicts garment 400 with the zipper 414 in an open state. FIG. 13 depicts garment 400 with the zipper 414 in a closed state. One skilled in the art will recognize that the garment 400 and privacy control feature 402 may vary in design, materials and/or style and remain within the scope and spirit of the present disclosure. For example, garment 400 may comprise any style of pant design having an opening, such as jeans, capris, shorts, yoga pants, pajama bottoms, slacks and other styles. Such opening may be closable using any temporary attachment means including a zipper, buttons, hook-and-loop tape and other forms of attachment. In the depicted embodiment, the opening may be closed through zipper 414 and engaging button 418 with button hole 416. The location and/or type of the opening or temporary attachment may be altered. In addition, design elements may vary and remain within the scope and spirit of the present disclosure. In the depicted embodiment, the garment 400 includes a internal zipper cover 422 which provides a layer of material between zipper 414 and the user's body.

In this embodiment, privacy control feature 402 includes a tension layer proximate to the crotch of a person. The tension layer of this embodiment comprises a split tension component 404. This split is illustrated by the interior edges 412 of the tension component 404. In some embodiments, garment 400 may include a liner covering tension component 404 in whole or in part. The tension component 404 is attached at the base of the crotch of garment 400 at bottom connection 406. Along the top of the garment 400 a first part of the split tension component 404 is attached at top connection 408 on a first side of the zipper 414 and a second part of the split tension component 404 is attached at top connection 410 on a second side of the zipper 414. Bottom connection 406 and top connections 408 and 410 may comprise any one or more manners for attaching the tension component 404 to the garment 400. For example, bottom connection 406 may comprise a stitched seam, top connection 408 may comprise an adhesive and top connection 410 may comprise a rivet connection. In some embodiments, the privacy control feature 402 may be attached such that it is removable and replaceable. In such embodiments, a user may have a series of garments which may be operatively engageable or attachable with one or more privacy control features 402. Other garments which may be operatively engageable with the privacy control feature 402 may or may not include an opening.

In some embodiments, the tension component 404 is designed to provide a variety of tension characteristics at locations through the fabric. For example, tension component 404 may be constructed to provide more tension at desired locations, such as the anticipated area proximate to the wearer's labia below the location where the internal edges 412 of tension component 404 meet, and lower levels of tension at other locations, such as the outer edge 420 of the tension component 404. For another example, the tension component 404 may be constructed to focus tension in desired directions, such as crossing angular directions. When providing crossing angular tension, the area in which the tension crosses may comprise the area of focused tension associated with the wearer's crotch. The design of the materials, dimensions, tension and other characteristics of tension component 404 may be varied to conceal, obfuscate or eliminate the curvature of the wearer's body. The tension component 404 may be controlled, influenced, or modified through fabric design methods including weaving, material selection, layering, tension modification techniques and/or other means of influencing the tension characteristics.

FIG. 13 depicts the garment 400 with the opening closed. When a woman is wearing garment 400, the split of tension component 404 extends from bottom connection 406 diagonally to the first top connection 408 and diagonally to the second top connection 410. The joined area of tension component 404 is operatively engaged with the crotch of the woman to provide a pressure against the external portion of the woman's genitalia. Closing the opening alters the pressure characteristics of the tension component 404 for a user when worn. For example, the distance between the first top connection 408 and the second top connection 410 is decreased in the closed state shown in FIG. 13. For another example, the garment design may provide for reduced pressure when the opening is open and increased pressure when the opening is closed. One skilled in the art will recognize that the garment 400 and privacy control feature 402 may be designed such that the preferred pressure is created when the opening is closed.

In some embodiments, the pressure from tension component 404 is in an upward direction to lift the labia and conceal, eliminate and/or obfuscate any visible curvature of the female anatomy. In some embodiments, the pressure from tension component 404 is in a direction towards the woman's back to conceal, eliminate and/or obfuscate any visible curvature of the female anatomy. The pressure may be directed in one or more directions, such as upward, inward, outward, towards the woman's back and/or combinations thereof, to create pressure against a woman's body in order to conceal, eliminate and/or obfuscate any visible curvature of the female anatomy. One skilled in the art will recognize that the direction of pressure created by the tension layer may vary while operating to conceal, eliminate and/or obfuscate any visible curvature of the female anatomy.

Embodiments of garments with tension layers may be designed to fit different sizes and shapes of the various wearers. In addition, the extent and location of pressure provided by the tension layer may vary in different embodiments. In some embodiments, the garment 400 in conjunction with the tension component 404 may be designed to fit differing body types through the extent, location, size and other characteristics of the tension components. In some embodiments, the garment 400 in conjunction with the tension component 404 may be designed to compliment another garment to wear over or under garment 400. For example, a woman may wear a pair of panties under garment 400 which would provide an additional layer between the privacy control feature 402 and the woman's labia. One skilled in the art will recognize that the number of tension layers and/or tension components within a tension layer may vary and remain within the scope and spirit of the present disclosure.

Figure 14:
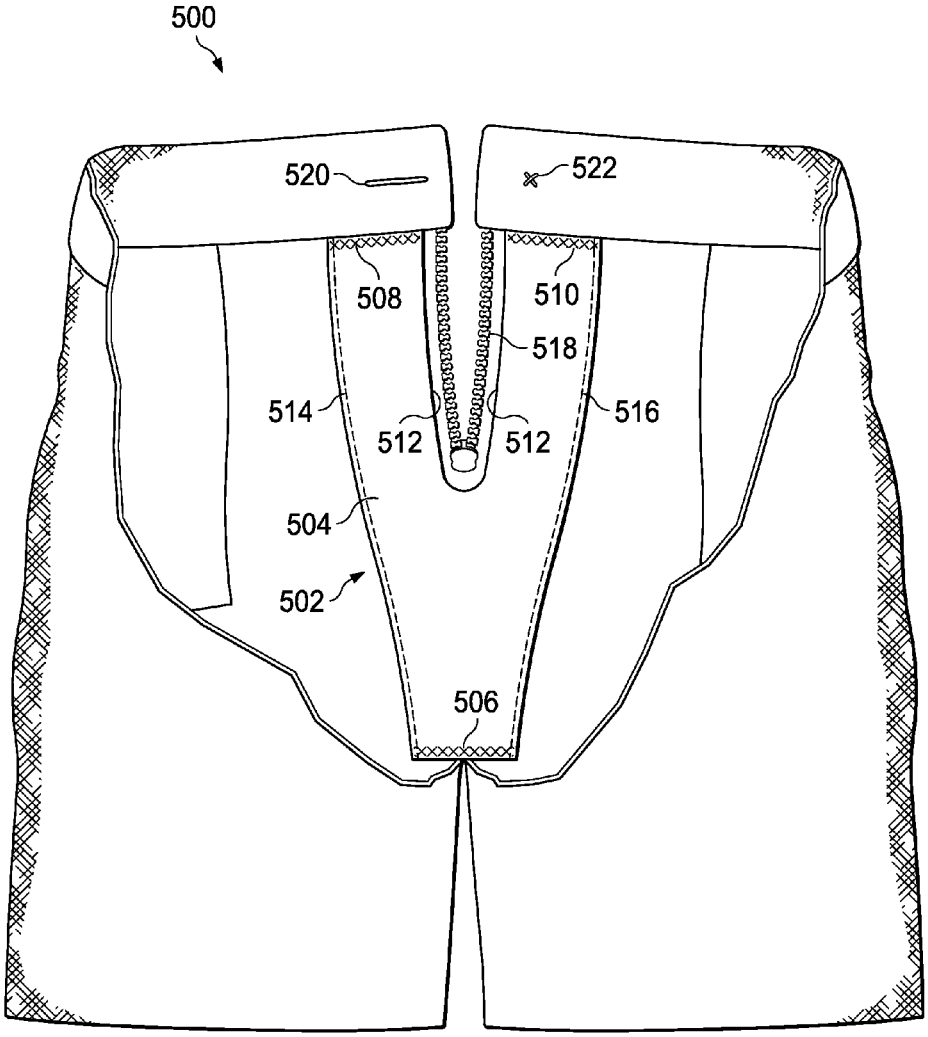
FIG. 14 is another embodiment of pants including a single elastomeric layer.

FIG. 14 depicts an embodiment of garment 500 having a zipper 518. The garment 500 is shown without the rear portion in order to illustrate a privacy control feature 502. Zipper 518 is shown in an open state, but may be worn in a closed state. One skilled in the art will recognize that the garment 500 and privacy control feature 502 may vary in design, materials and/or style and remain within the scope and spirit of the present disclosure. For example, garment 500 may comprise any style of pant design having an opening, such as jeans, capris, shorts, yoga pants, pajama bottoms, slacks and other styles. Such opening may be closable using any temporary attachment means including a zipper, buttons, hook-and-loop tape and other forms of attachment. In the depicted embodiment, the opening may be closed through zipper 518 and engaging button 522 with button hole 520. The location and/or type of the opening or temporary attachment may be altered. In addition, design elements may vary and remain within the scope and spirit of the present disclosure.

In this embodiment, privacy control feature 502 includes a tension layer proximate to the crotch of a person. The tension layer of this embodiment comprises a split tension component 504. This split is illustrated by the interior edges 512 of the tension component 504. In some embodiments, garment 500 may include a liner covering tension component 504 in whole or in part. The tension component 504 is attached at the base of the crotch of garment 500 at bottom connection 506. Along the top of the garment 500 a first part of the split tension component 504 is attached at top connection 508 on a first side of the zipper 518 and a second part of the split tension component 504 is attached at top connection 510 on a second side of the zipper 518. Bottom connection 506 and top connections 508 and 510 may comprise any one or more manners for attaching the tension component 504 to the garment 500. For example, bottom connection 506 may comprise a stitched seam and top connections 508 and 510 may comprise adhesive connections.

In this embodiment, the outer sides of tension component 504 are also shown to be attached to the garment 500 by side connections 514 and 516. In some embodiments, the side connections 514 and 516 may provide flexible connections which work in conjunction with the tension component 504 to direct the tension and modify the pressure on the wearer's genitalia to prevent, obfuscate or conceal the curvature from being visible. In some embodiments, the side connections 514 and 516 provide a loose connection to hold the tension component 504 in a general vicinity without interfering with the ability of tension component 504 to move freely during operation. For example, side connections 514 and 516 may comprise a loose stitch that allows sufficient movement of the tension component 504. As discussed within the disclosure the connection design, materials, and operation may vary and remain within the scope and spirit of the disclosure.

In some embodiments, the privacy control feature 502 may be attached such that it is removable and replaceable. In such embodiments, a user may have a series of garments which may be operatively engageable or attachable with one or more privacy control features 502. Other garments which may be operatively engageable with the privacy control feature 502 may or may not include an opening.

In some embodiments, the tension component 504 is designed to provide a variety of tension characteristics at locations through the fabric. For example, tension component 504 may be constructed to provide more tension at desired locations, such as the anticipated area proximate to the wearer's labia below the location where the internal edges 512 of tension component 504 meet, and lower levels of tension at other locations, such as the outer edge of the tension component 504. For another example, the tension component 504 may be constructed to focus tension in desired directions, such as crossing angular directions. When providing crossing angular tension, the area in which the tension crosses may comprise the area of focused tension associated with the wearer's crotch. The design of the materials, dimensions, tension and other characteristics of tension component 504 may be varied to conceal, obfuscate or eliminate the curvature of the wearer's body. The tension component 504 may be controlled, influenced, or modified through fabric design methods including weaving, material selection, layering, tension modification techniques and/or other means of influencing the tension characteristics.

When a woman is wearing garment 500, the split of tension component 504 extends from bottom connection 506 diagonally to the first top connection 508 and diagonally to the second top connection 510. The joined area of tension component 504 is operatively engaged with the crotch of the woman to provide a pressure against the external portion of the woman's genitalia. Closing the opening alters the pressure characteristics of the tension component 504 for a user when worn. For example, the distance between the first top connection 508 and the second top connection 510 is decreased in the closed state. For another example, the garment design may provide for reduced pressure when the opening is open and increased pressure when the opening is closed. One skilled in the art will recognize that the garment 500 and privacy control feature 502 may be designed such that the preferred pressure is created when the opening is closed.

In some embodiments, the pressure from tension component 504 is in an upward direction to lift the labia and conceal, eliminate and/or obfuscate any visible curvature of the female anatomy. In some embodiments, the pressure from tension component 504 is in a direction towards the woman's back to conceal, eliminate and/or obfuscate any visible curvature of the female anatomy. The pressure may be directed in one or more directions, such as upward, inward, outward, towards the woman's back and/or combinations thereof, to create pressure against a woman's body in order to conceal, eliminate and/or obfuscate any visible curvature of the female anatomy. One skilled in the art will recognize that the direction of pressure created by the tension layer may vary while operating to conceal, eliminate and/or obfuscate any visible curvature of the female anatomy.

Embodiments of garments with tension layers may be designed to fit different sizes and shapes of the various wearers. In addition, the extent and location of pressure provided by the tension layer may vary in different embodiments. In some embodiments, the garment 500 in conjunction with the tension component 504 may be designed to fit differing body types through the extent, location, size and other characteristics of the tension components. In some embodiments, the garment 500 in conjunction with the tension component 504 may be designed to compliment another garment to wear over or under garment 500. For example, a woman may wear a pair of panties under garment 500 which would provide an additional layer between the privacy control feature 502 and the woman's labia. One skilled in the art will recognize that the number of tension layers and/or tension components within a tension layer may vary and remain within the scope and spirit of the present disclosure.

Figure 15:
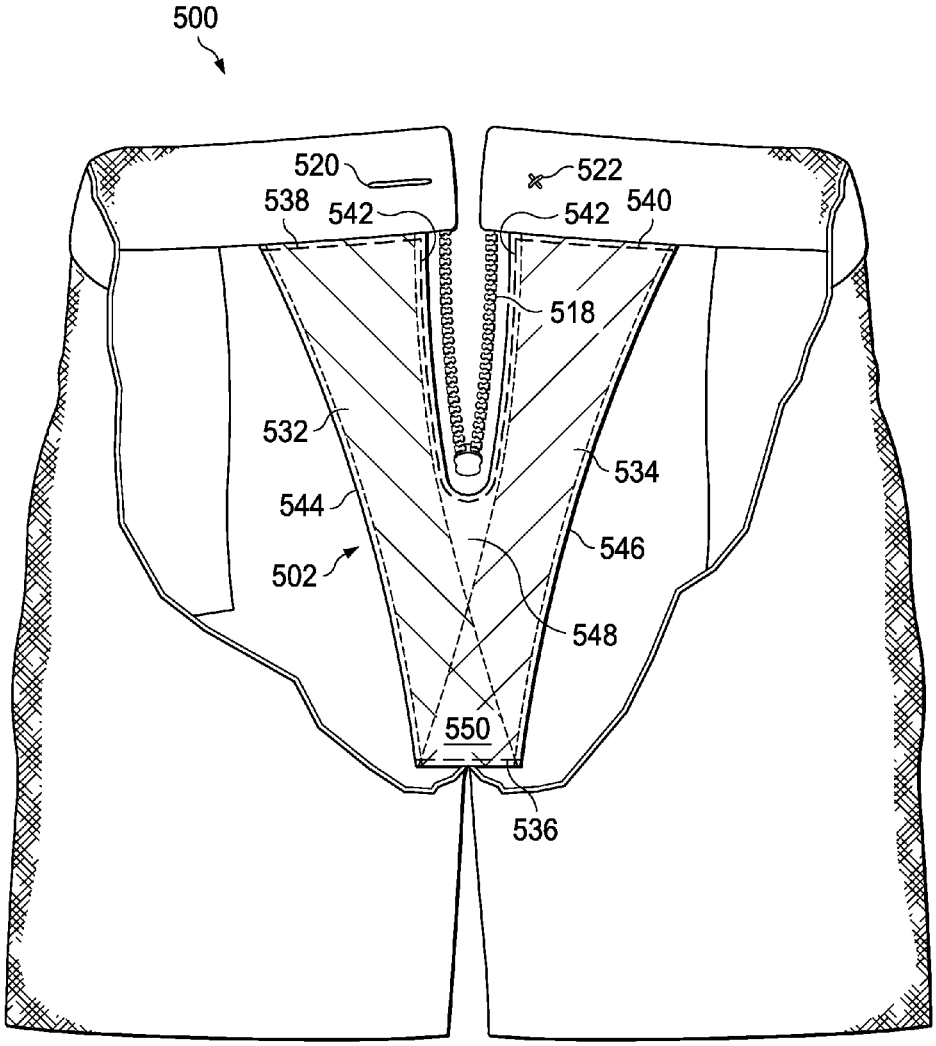
FIG. 15 is another embodiment of pants including two elastomeric layers.

FIG. 15 depicts an embodiment of garment 500 having a zipper 518. The garment 500 is shown without the rear portion in order to illustrate a privacy control feature 502. Zipper 518 is shown in an open state, but may be worn in a closed state. One skilled in the art will recognize that the garment 500 and privacy control feature 502 may vary in design, materials and/or style and remain within the scope and spirit of the present disclosure. For example, garment 500 may comprise any style of pant design having an opening, such as jeans, capris, shorts, yoga pants, pajama bottoms, slacks and other styles. Such opening may be closable using any temporary attachment means including a zipper, buttons, hook-and-loop tape and other forms of attachment. In the depicted embodiment, the opening may be closed through zipper 518 and engaging button 522 with button hole 520. The location and/or type of the opening or temporary attachment may be altered. In addition, design elements may vary and remain within the scope and spirit of the present disclosure.

In this embodiment, privacy control feature 502 includes a tension layer proximate to the crotch of a person. The tension layer of this embodiment comprises a first tension component 532 and a second tension component 534. In the depicted embodiment, garment 500 includes a liner 548 covering tension components 532 and 534 in whole or in part. Each of the tension components 532 and 534 are attached at the base of the crotch of garment 500 at bottom connection 536. First tension component 532 is attached along the top at first top connection 538 on the first side of zipper 518 and second tension component 534 is attached along the top at second top connection 540 on the second side of zipper 518. Bottom connection 536 and top connections 538 and 540 may comprise any one or more manners for attaching the tension components 532 and 534 to the garment 500. For example, bottom connection 536 may comprise a stitched seam and top connections 538 and 540 may comprise an adhesive.

In this embodiment, the liner 548 is also attached at the bottom connection 536 and top connections 538 and 540. In some embodiments, the liner 548 and tension components 532 and 534 are attached to the garment 500 together. In some embodiments, the liner 548 and tension components 532 and 534 are separately attached to the garment 500. In this embodiment, the interior edges of the liner 548 are also attached to garment 500 around the zipper 518 by interior connection 542. In this embodiment, the liner 548 prevents the tension components 532 and 534 from crossing over the zipper 518. This may prevent the tension components 532 and 534 from being caught in the zipper 518 and/or may hide the tension components 532 and 534 from view when the zipper 518 is open. In some embodiments, the outer edges 544 and 546 of liner 548 may also be attached to the garment 500. In some embodiments, the interior edges of the liner 548 and/or the outer edges 544 and 546 of liner 548 may not be attached to the garment 500. The liner 548 and attachment thereof may be designed not to interfere with the operation of tension components 532 and 534.

In some embodiments, the privacy control feature 502 may be attached such that it is removable and replaceable. In such embodiments, a user may have a series of garments which may be operatively engageable or attachable with one or more privacy control features 502. Other garments which may be operatively engageable with the privacy control feature 502 may or may not include an opening.

In some embodiments, tension components 532 and 534 cross each other such that an increased level of support is provided around a desired location wherein tension components 532 and 534 overlap. Overlap portion 550 shows the overlap in the front of the tension layer of privacy control feature 502. In some embodiments, the tension layer is utilized to conceal, eliminate and/or obfuscate the external portion of a woman's genitalia when the garment 500 is worn. One skilled in the art will recognize that garment 500 may be worn in conjunction with other garments and undergarments. For example, a woman may wear a pair of panties under garment 500 which would provide an additional layer between the privacy control feature 502 and the woman's labia.

In some embodiments, the tension components 532 and 534 are designed to provide a variety of tension characteristics at locations through the materials. For example, tension components 532 and 534 may be constructed to provide more tension at desired locations, such as the anticipated area proximate to the wearer's labia, and lower levels of tension at other locations, such as the outer edge of the tension components 532 and 534. For another example, the tension components 532 and 534 may be constructed to focus tension in desired directions, such as crossing angular directions. When providing crossing angular tension, the overlap portion 550 in which the tension crosses may comprise the area of focused tension associated with the wearer's crotch. The design of the materials, dimensions, tension and other characteristics of tension components 532 and 534 may be varied to conceal, obfuscate or eliminate the curvature of the wearer's body. The tension components 532 and 534 may be controlled, influenced, or modified through fabric design methods including weaving, material selection, layering, tension modification techniques and/or other means of influencing the tension characteristics.

When a woman is wearing garment 500, tension component 532 extends from bottom connection 536 diagonally to the first top connection 538 and is operatively engaged with the crotch of the woman to provide a pressure against the external portion of the woman's genitalia. In addition, tension component 534 extends from bottom connection 536 diagonally to second top connection 540 crossing over tension component 532 and is operatively engaged with the crotch of the woman to provide a pressure against the external portion of the woman's genitalia. The overlap portion 550 may be designed to cover the woman's labia such that a combined pressure created by each of tension components 532 and 534 is applicable to at least a portion of the woman's labia. In some embodiments, the overlap portion 550 is designed to cover the woman's labia completely.

Closing the opening alters the pressure characteristics of the tension components 532 and 534 for a user when worn. For example, the distance between the first top connection 538 and the second top connection 540 is decreased in the closed state. For another example, the garment design may provide for reduced pressure when the opening is open and increased pressure when the opening is closed. One skilled in the art will recognize that the garment 500 and privacy control feature 502 may be designed such that the preferred pressure is created when the opening is closed.

In some embodiments, the pressure from tension components 532 and 534 is in an upward direction to lift the labia and conceal, eliminate and/or obfuscate any visible curvature of the female anatomy. In some embodiments, the pressure from tension components 532 and 534 is in a direction towards the woman's back to conceal, eliminate and/or obfuscate any visible curvature of the female anatomy. The pressure may be directed in one or more directions, such as upward, inward, outward, towards the woman's back and/or combinations thereof, to create pressure against a woman's body in order to conceal, eliminate and/or obfuscate any visible curvature of the female anatomy. One skilled in the art will recognize that the direction of pressure created by the tension layer may vary while operating to conceal, eliminate and/or obfuscate any visible curvature of the female anatomy.

Embodiments of garments with tension layers may be designed to fit different sizes and shapes of the various wearers. In addition, the extent and location of pressure provided by the tension layer may vary in different embodiments. In some embodiments, the garment 500 in conjunction with the tension components 532 and 534 may be designed to fit differing body types through the extent, location, size and other characteristics of the tension components. In some embodiments, the garment 500 in conjunction with the tension components 532 and 534 may be designed to compliment another garment to wear over or under garment 500. For example, a woman may wear a pair of panties under garment 500 which would provide an additional layer between the privacy control feature 502 and the woman's labia. One skilled in the art will recognize that the number of tension layers and/or tension components within a tension layer may vary and remain within the scope and spirit of the present disclosure.

The garments described in the present disclosure may be utilized for functional support apart from the privacy control purposes. In some embodiments, one or more tension components may be incorporated into medical garments to provide medically beneficial support to a designated area. For example, a garment with tension control features may be used following surgery, such as a labiaplasty operation, a vaginal rejuvenation procedure, or post-pregnancy to support the woman's crotch. For another example, a garment with tension control features may be used following a vasectomy to support a man's genitalia. The additional support may improve the time and/or success of the healing process. The support may further improve the comfort of a wearer following a procedure.

Figure 16:
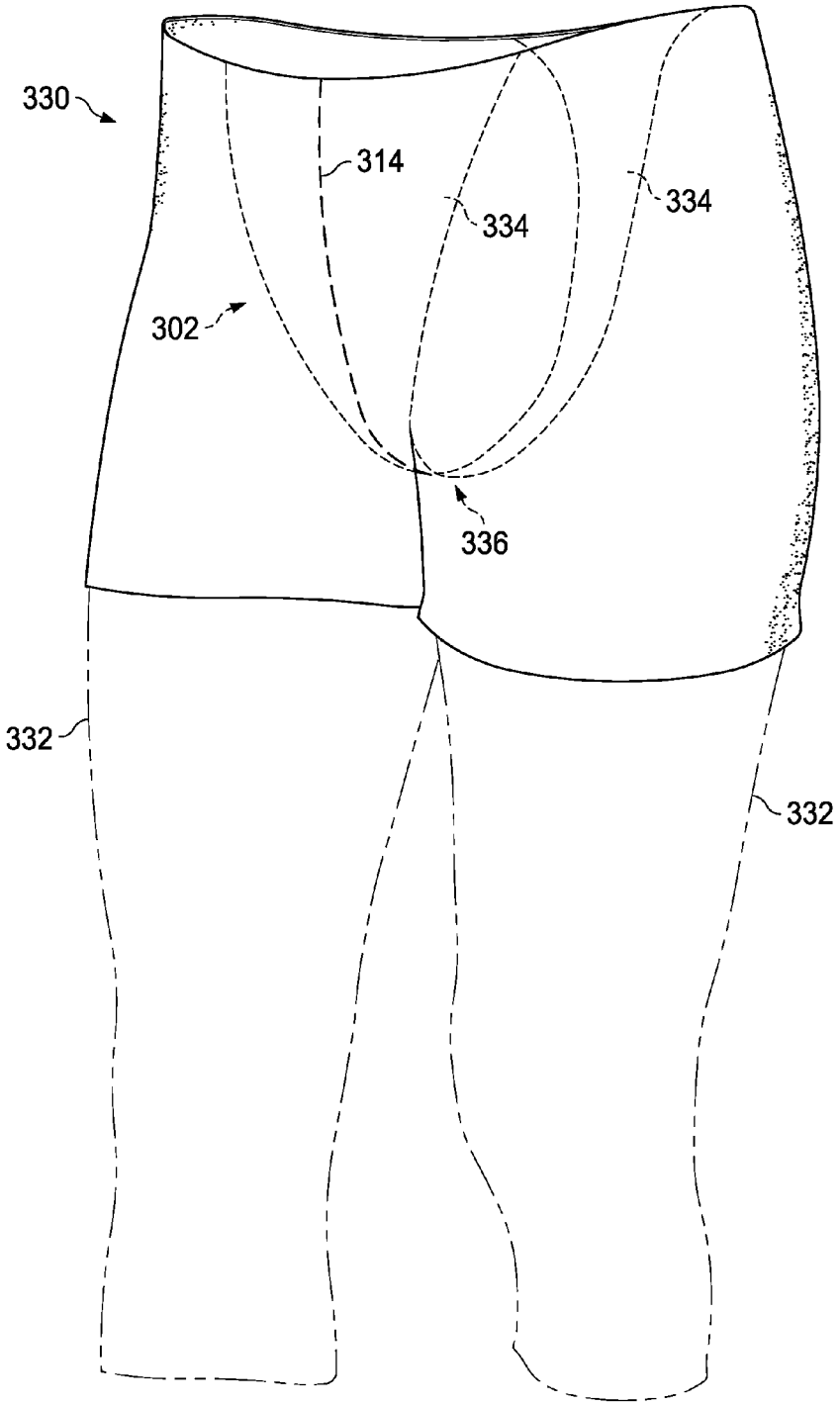
FIG. 16 is an embodiment of shorts including an elastomeric layer extending from the front to the back.

FIG. 16 depicts another exemplary embodiment of garment 330 with a privacy control feature 302 worn by a person. In this embodiment, garment 330 comprises a pair of shorts. In some embodiments, the garment 330 may comprise other types of garments or undergarments such as, compression-wear, boy-shorts, etc. The legs 332 of the person are shown for context. One skilled in the art will recognize that the garment 330 and privacy control feature 302 may vary in design, materials and/or style and remain within the scope and spirit of the present disclosure. In addition, design elements may vary and remain within the scope and spirit of the present disclosure. For example, seam 314 is shown vertically in approximately the center of the garment 330 in this embodiment; however, the location and/or type of the seam 314 may be altered or eliminated all together.

In this embodiment, privacy control feature 302 includes a tension layer proximate to the crotch of a person. In this embodiment, the tension layer comprises a tension component 334. In some embodiments, garment 330 may include a liner covering tension component 334 in whole or in part. Tension component 334 may perform the same functions as multiple tension components. One skilled in the art will recognize that one or more tension components may be utilized in embodiments of the disclosure. In some embodiments, tension component 334 may provide a constant tension characteristic across the entirety of the tension component 334. For example, tension component 334 may comprise a single elastomeric fabric which provides a constant tension throughout the material.

In some embodiments, the tension component 334 is designed to provide a variety of tension characteristics at locations through the fabric. For example, tension component 334 may be constructed to provide more tension at desired locations, such as the anticipated area proximate to the wearer's labia, and lower levels of tension at other locations, such as the edge of the tension component 334. For another example, the tension component 334 may be constructed to focus tension in desired directions, such as crossing angular directions. When providing crossing angular tension, the area in which the tension crosses may comprise the area of focused tension associated with the wearer's crotch. The design of the materials, dimensions, tension and other characteristics of tension component 334 may be varied to conceal, obfuscate or eliminate the curvature of the wearer's body. The tension component 334 may be controlled, influenced, or modified through fabric design methods including weaving, material selection, layering, tension modification techniques and/or other means of influencing the tension characteristics.

When worn by a woman, the tension component 334 and/or an active or selected portion of tension component 334 would be designed to cover the labia of the woman in order to focus the pressure at the desired location to conceal, obfuscate and/or eliminate any view of the curvature of the woman's labia. One skilled in the art will recognize that one design of garment 330 may operate, affect or be worn differently by different women due to a variety of characteristics associated with each woman's body type. Elements of this disclosure may be varied to create a series of garments to correspond to various body types, in order to provide users with the options to select garments best suited for that user's body type.

In this embodiment, the tension component 334 extends from the top-front of the garment 330 to the top-back of the garment 330. The tension component 334 is wider in the front and narrows through a bottom section 336 before widening near the top-back of the garment 330. One skilled in the art will recognize that the design of the tension component 334 which extends from the top-front to the top-back of the garment 330 may be applied to other embodiments disclosed herein and other garments while remaining within the scope and spirit of the present disclosure.

In this embodiment, the tension component 334 is attached along the front at the top waist line and along the back at the top waist line. In some embodiments, the tension component 334 may be attached along the front and/or the back at a location dropped below the top waist line. For example, the tension component 334 may be attached to a seam dropped between 0.5 and 4 inches from the top waist line. The connections in the front and/or the back may comprise any one or more manners for attaching the tension component 334 to the garment 330. For example, the connections may comprise a stitched seam and an adhesive.

In some embodiments, the tension layer may include two or more tension components which designed to overlap proximate to the wearer's crotch. For example, when worn by a woman, the overlap would be designed to cover the labia of the woman in order to focus the pressure at the desired location to conceal, obfuscate and/or eliminate any view of the curvature of the woman's labia. In some embodiments, the overlapping components may only cover a portion of the woman's labia.

In some embodiments, the tension layer extending from the top-front to the top-back of the garment 330 may include one or more front tension components and one or more rear tension components which attach to each other at a bottom connection proximate to the bottom section 336. For example, multiple front tension components may attach to a single rear tension component at a bottom connection proximate to the bottom section 336.

In some embodiments, the tension component 334 (or an alternative version of the tension layer comprising multiple tension components) may also be attached to the garment 330 at a bottom connection proximate to bottom section 336. In such embodiments, the bottom connection may operate as a fixed connection between the garment 330 and the tension component 334 which limits the movement between the garment 330 and the tension component 334 at the connection point. In some embodiments, the bottom connection may be a loose connection which allows movement between the garment 330 and the tension component 334 while maintaining the relative orientation of the tension component 334 to the garment 330. One skilled in the art will recognize that different connections may be used to provide different allowances for movement between the garment 330 and the tension component 334 and remain within the scope and spirit of the present disclosure.

One skilled in the art will recognize that one design of garment 330 may operate, affect or be worn differently by different women due to a variety of characteristics associated with each woman's body type. Elements of this disclosure may be varied to create a series of garments to correspond to various body types, in order to provide users with the options to select garments best suited for that user's body type.

In some embodiments, the privacy control feature 302 may be attached such that it is removable and replaceable. In such embodiments, a user may have a series of garments which may be operatively engageable or attachable with one or more privacy control features 302. In the embodiment shown, tension component 334 is wider along the top than it is along bottom section 336. In some embodiments, the tension component 334 is a rectangular strip of material or a plurality of strips of material. One skilled in the art will recognize that that the size, shape and other characteristics of the tension component 334 may vary and remain within the scope and spirit of the present disclosure.

One skilled in the art will recognize that garment 330 may be worn in conjunction with other garments and undergarments. For example, a woman may wear a pair of panties under garment 330 which would provide an additional layer between the privacy control feature 302 and the woman's labia. Different garments 330 may be designed for either wearing or not wearing additional garments. For example, a woman may elect to purchase workout shorts to wear without panties to avoid undesired panty lines. The privacy control feature 302 in conjunction with the material of the shorts may be breathable and comfortable materials designed to wick away moisture to maintain further comfort during an exercise class. For example, the material may comprise a mesh design for the tension component 334 of the privacy control feature 302 while the garment 330 uses a tight but breathable fabric to prevent a see-through effect which the mesh may allow.

In some embodiments, the pressure from tension component 334 is in an upward direction to lift the labia and conceal, eliminate and/or obfuscate any visible curvature of the female anatomy. In some embodiments, the pressure from tension component 334 is in a direction towards the woman's back to conceal, eliminate and/or obfuscate any visible curvature of the female anatomy. The pressure may be directed in one or more directions, such as upward, inward, outward, towards the woman's back and/or combinations thereof, to create pressure against a woman's body in order to conceal, eliminate and/or obfuscate any visible curvature of the female anatomy. One skilled in the art will recognize that the direction of pressure created by the tension layer may vary while operating to conceal, eliminate and/or obfuscate any visible curvature of the female anatomy.

Embodiments of garments with tension layers may be designed to fit different sizes and shapes of the various wearers. In addition, the extent and location of pressure provided by the tension layer may vary in different embodiments. In some embodiments, the garment 330 in conjunction with the tension component 334 may be designed to fit differing body types through the extent, location, size and other characteristics of the tension components. In some embodiments, the garment 300 in conjunction with the tension component 334 may be designed to compliment another garment to wear over or under garment 330. One skilled in the art will recognize that the number of tension layers and/or tension components within a tension layer may vary and remain within the scope and spirit of the present disclosure.

The invention being thus described and further described in the claims, it will be obvious that the same may be varied in many ways. Such variations are not to be regarded as a departure from the scope and spirit of the invention and all such modifications as would be obvious to one skilled in the art are intended to be included within the scope of the apparatus and method described.

The invention claimed is:

1. A garment having a privacy control feature comprising:

a garment adapted to cover an area proximate to a wearer's crotch comprising a garment material, wherein said garment includes a front portion and a back portion which are adapted to meet at a garment bottom beneath said wearer's crotch; and a tension layer connected to said garment from a bottom connection proximate to said garment bottom and a top connection adapted to be proximate to said wearer's waist in said front portion, wherein said garment material between said bottom connection and said top connection is longer than said tension layer in a relaxed state and said tension layer is adapted to expand when worn by the wearer and adapted to produce pressure at a focal area proximate to genitalia of the wearer.

2. The garment according to claim 1, wherein said tension layer comprises:

a first tension component attached to a first side of said bottom connection and an opposite second side of said top connection; and a second tension component attached to a second side of said bottom connection and an opposite first side of said top connection;

wherein said first tension component and said second tension component overlap at said focal area.

3. The garment according to claim 2, further comprising a liner connected to said garment at said bottom connection and said top connection, wherein said liner is adapted to be between said tension layer and said wearer.

4. The garment according to claim 3, wherein said liner provides at least one of comfort, breathability, moisture absorption, odor absorption, and/or feminine hygiene.

5. The garment according to claim 3, wherein said liner is designed from at least one of cottons, nylons, polyesters, and/or silk.

6. The garment according to claim 3, wherein said liner comprises a lower part adjacent to said bottom connection and an upper part adjacent to said top connection, wherein said lower part comprises a first material and said upper part comprises a second material, and wherein said first material differs from said second material.

7. The garment according to claim 2, further comprising a liner connected to said garment at said bottom connection and extending partially toward said top connection, wherein said liner is adapted to be between a portion of said tension layer and said wearer.

8. The garment according to claim 1, wherein said tension layer is designed from at least one of cottons, nylons, polyesters, silk, rubbers, elastics, and/or neoprene.

9. The garment according to claim 1, wherein said tension layer comprises a tension component designed to provide a variety of pressure characteristics across said tension component wherein said focal area receives increased pressure relative to other portions of said tension component.

10. A woman's garment having a privacy control feature comprising:

a garment configured to cover an area proximate to said woman's crotch comprising a garment material, wherein said garment includes a front portion and a back portion which are configured to meet at a garment bottom beneath said wearer's crotch; and at least one tension component connected to said garment from a bottom connection proximate to said garment bottom and a top connection configured to be proximate to said woman's waist in said front portion, wherein said tension component is configured to provide cross-directional pressure at a focal area proximate to genitalia of the wearer, wherein said garment material between said bottom connection and said top connection is longer than said at least one tension component in a relaxed state and said at least one tension component is adapted to expand when worn by the wearer and adapted to produce pressure at a focal area proximate to genitalia of the wearer.

11. The garment according to claim 10, wherein said garment is an undergarment.

12. The garment according to claim 10, wherein said garment is at least one of a panty, a yoga pant, a yoga short, a workout bottom, and/or a pair of pants.

13. A privacy control apparatus for use in a garment comprising:

at least one tension component having a top section and a bottom section, wherein said top section is connectable to said garment proximate to a frontal waist of said garment, and wherein said bottom section is connectable to said garment proximate to a garment bottom of said garment; and wherein said tension component is adapted to provide cross-directional pressure at a focal area proximate to genitalia of a person when said person wears said garment with said privacy control apparatus, wherein said at least one tension component comprises:

a first tension component extending from a first side of said bottom section to an opposite second side of said top section; and a second tension component extending from a second side of said bottom section to an opposite first side of said top section;

wherein said first tension component and said second tension component overlap at said focal area.

14. The apparatus according to claim 13, wherein said top section comprises a top tension component connection which is removably connectable to a top garment connection associated with said garment; and said bottom section comprises a bottom tension component connection which is removably connectable to a bottom garment connection associated with said garment.

15. The apparatus according to claim 14, wherein said apparatus is configured to removably connect to each of a plurality of garments, wherein said tension component is configured to provide cross-directional pressure at a focal area proximate to genitalia of said person for each of said plurality of said garments when said apparatus is connected to said garment worn by said person.

16. The apparatus according to claim 13, wherein at least one of said top section and said bottom section is connectable to said garment by at least one of a sewn connection, an adhesive connection and/or a fitted connection.

17. The apparatus according to claim 13, wherein said frontal waist of said garment comprises a dropped waistband.

18. The apparatus according to claim 13, wherein said tension component is configured to provide sufficient tension at said focal area to obfuscate the visual protrusion of said genitalia through said wearer's garment.

19. The apparatus according to claim 13, wherein said tension component is configured to provide sufficient tension at said focal area to support said genitalia.

20. The apparatus according to claim 13, further comprising an encasement which encases said tension component between two layers of material whereby said first tension component and said second tension component remain freely moveable within said encasement.

21. A garment having a privacy control feature comprising:

a first leg portion;

a second leg portion;

a front panel located in a front of said garment from a garment bottom to a garment top adapted to be proximate to a wearer's waist, wherein said front panel is between said first leg portion and said second leg portion and comprises a garment material;

a first seam which connects said first leg portion and said front panel;

a second seam which connects said second leg portion and said front panel, wherein said first seam and said second seam are at angles which cause a distance between said first seam and said second seam to widen from the garment bottom to the garment top; and wherein said front panel is adapted to be proximate to said wearer's crotch and wherein said front panel is adapted to obfuscate the wearer's genitalia, a tension component connected to said garment from a bottom connection proximate to said garment bottom and a top connection proximate to said garment top, wherein said garment material between said bottom connection and said top connection is longer than said tension component in a relaxed state and said tension component is adapted to expand when worn by the wearer and adapted to produce pressure at a focal area proximate to genitalia of the wearer.

22. The garment according to claim 21, wherein said front panel comprises a liner material.

23. The garment according to claim 22, wherein said liner material provides at least one of comfort, breathability, moisture absorption, odor absorption, and/or feminine hygiene.

24. The garment according to claim 21, wherein said front panel is designed from at least one of cottons, nylons, polyesters, silk, rubbers, elastics, spandex and/or neoprene.

25. The garment according to claim 21, wherein the front panel comprises a material designed to incorporate tension characteristics and liner characteristics.

26. The garment according to claim 21, wherein said tension component comprises a material designed to incorporate tension characteristics which apply pressure to a focal point adapted to be proximate to the wearer's genitalia.

27. The garment according to claim 26, wherein said pressure at said focal point is based a weave design of said material incorporating said tension characteristics.

28. The garment according to claim 21, wherein the front panel is designed to incorporate liner characteristics.

29. The garment according to claim 21, wherein said garment is an undergarment.

30. The garment according to claim 21, wherein said garment is at least one of a panty, a yoga pant, a workout bottom, and/or a pair of pants.

31. The garment according to claim 21, wherein the angles of said first seam and said second seam are designed to obfuscate a characteristic of an other garment.

32. A privacy control apparatus for use in a garment comprising:

at least one tension component having a top-frontal section, a top-rear section and a bottom section, wherein said top-frontal section is connectable to said garment proximate to a frontal waist of said garment, said top-rear section is connectable to said garment proximate to a rear waist of said garment, and wherein said bottom section is proximate to a garment bottom of said garment; and wherein said tension component is adapted to provide cross-directional pressure at a focal area proximate to genitalia of a person when said person wears said garment with said privacy control apparatus, wherein said at least one tension component comprises:

a first tension component extending from a first side of said bottom section to an opposite second side of said top-frontal section;

a second tension component extending from a second side of said bottom section to an opposite first side of said top-frontal section; and a third tension component extending from said bottom section to said top-rear section;

wherein said first tension component and said second tension component attach to said third tension component in said bottom section, and wherein said first tension component and said second tension component overlap at said focal area.

33. The apparatus according to claim 32, wherein at least one of said top-frontal section, said top-rear section and/or said bottom section is connectable to said garment by at least one of a sewn connection, an adhesive connection and/or a fitted connection.

34. The apparatus according to claim 32, wherein said bottom section is connectable to said garment.

35. The apparatus according to claim 32, wherein said tension component is adapted to provide sufficient tension at said focal area to obfuscate the visual protrusion of said genitalia through said wearer's garment.

36. The apparatus according to claim 32, wherein said tension component is adapted to provide sufficient tension at said focal area to support said genitalia.

37. The apparatus according to claim 32, further comprising a liner.

* * * * *